US007297960B2

(12) United States Patent
Brown et al.

(10) Patent No.: US 7,297,960 B2
(45) Date of Patent: Nov. 20, 2007

(54) MASS SPECTROMETER

(75) Inventors: Jeffery Mark Brown, Cheshire (GB); Daniel James Kenny, Cheshire (GB)

(73) Assignee: Micromass UK Limited (GB)

( * ) Notice: Subject to any disclaimer, the term of this patent is extended or adjusted under 35 U.S.C. 154(b) by 435 days.

(21) Appl. No.: 10/989,646

(22) Filed: Nov. 16, 2004

(65) Prior Publication Data

US 2005/0151075 A1 Jul. 14, 2005

Related U.S. Application Data

(60) Provisional application No. 60/523,559, filed on Nov. 20, 2003.

(30) Foreign Application Priority Data

Nov. 17, 2003 (GB) ..... 0326717.6

(51) Int. Cl.
*G21K 1/08* (2006.01)
*H01J 3/14* (2006.01)
*H01J 3/26* (2006.01)

(52) U.S. Cl. ..... 250/396 R; 250/281; 250/282; 250/287

(58) Field of Classification Search ..... None
See application file for complete search history.

(56) References Cited

U.S. PATENT DOCUMENTS 4,933,551 A * 6/1990 Bernius et al. ..... 250/288
6,078,043 A 6/2000 Palmer
6,204,500 B1 * 3/2001 Whitehouse et al. ..... 250/287
6,403,952 B2 * 6/2002 Whitehouse et al. ..... 250/288
6,621,074 B1 * 9/2003 Vestal ..... 250/287
6,683,301 B2 * 1/2004 Whitehouse et al. ..... 250/288
6,906,319 B2 * 6/2005 Hoyes ..... 250/282

FOREIGN PATENT DOCUMENTS

| | | |
|---|---|---|
| GB | 2306766 | 5/1997 |
| JP | 2000285848 | 10/2000 |
| JP | 20002245964 | 8/2002 |
| WO | WO 97/48120 | 12/1997 |
| WO | WO 97/33203 | 7/1998 |
| WO | WO 99/01889 | 1/1999 |

* cited by examiner

*Primary Examiner*—Patrick Assouad
*Assistant Examiner*—Yara B Green
(74) *Attorney, Agent, or Firm*—Jamie H. Rose

(57) ABSTRACT

A mass filter is disclosed comprising an orthogonal acceleration electrode 9. Ions entering the mass filter are orthogonally accelerated by the orthogonal acceleration electrode 9 in a primary acceleration region 2 and enter a flight region 3. The ions 6,7,8 are then reflected by a reflectron 4 and are directed towards an exit region of the mass filter. Ions having a desired mass to charge ratio are arranged to arrive in the primary acceleration region 2 at a time when a voltage pulse applied to the orthogonal acceleration electrode 9 falls from a maximum to zero. Ions having a desired mass to charge ratio are orthogonally decelerated such that they have a zero component of velocity in the orthogonal direction. Accordingly, ions having a desired mass to charge ratio exit the mass filter in an axial direction.

76 Claims, 8 Drawing Sheets

| | Initial KE (eV) | Initial Position (mm) |
|---|---|---|
| GROUP 1 | 0.5 | -0.1 |
| GROUP 2 | 0.2 | -0.1 |
| GROUP 3 | 0.5 | 0 |
| GROUP 4 | 0.2 | 0 |
| GROUP 5 | 0.5 | +0.1 |
| GROUP 6 | 0.2 | +0.1 |

MASS SPECTROMETER

CROSS REFERENCE TO RELATED APPLICATIONS

This application claims priority from United Kingdom patent application GB-0326717.6 filed 17 Nov. 2003 and U.S. Provisional Application 60/523,559 filed 20 Nov. 2003. The contents of these applications are incorporated herein by reference.

FIELD OF THE INVENTION

The present invention relates to a mass filter and a mass spectrometer incorporating a mass filter.

BACKGROUND OF THE INVENTION

It is known to use a mass filter in a mass spectrometer to select parent ions having a certain mass to charge ratio. The selected parent ions may then, for example, be fragmented in a collision or fragmentation cell and the resulting fragment ions can then be mass analysed by a mass analyser. The mass filter most commonly used to select parent ions having a certain mass to charge ratio is a quadrupole rod set mass analyser. However, other types of mass filters are known including Wien filters and Bradbury-Nielsen ion gates.

A Wien filter operates by passing a beam of ions through crossed electric and magnetic fields. Ions having a mass m, charge q and velocity v will pass undeviated through the filter if:

$$Eq=Bqv$$

where E and B are the electric and magnetic field strengths respectively. Accordingly, if all the ions in an ion beam have essentially the same energy, then only ions having a particular mass to charge ratio will have the required velocity to pass through the filter undeflected. However, disadvantageously, the resolution of a Wien filter is dependent upon the absolute magnitude of the crossed electric and magnetic fields experienced by the ion beam. Since large magnetic fields require very large electromagnets then the ultimate resolution of a mass spectrometer incorporating a Wien filter is, in practice, fairly restricted, particularly at higher mass to charge ratios. A maximum mass to charge ratio resolution of approximately 400 is common for known mass spectrometers which incorporate a Wien filter. The mass to charge ratio resolution R may be defined as:

$$R = \frac{m}{\Delta m}$$

where Δm is a mass to charge ratio window transmitted at a mass to charge ratio m. The large physical size of the various components necessary to form a Wien filter in addition to its limited resolution has relegated its use to certain specialised areas such as atomic physics and ion implantation.

Quadrupole rod set mass filters, by contrast, are relatively compact and are commonly used in commercial mass spectrometers. A quadruple rod set mass filter comprises two electrically connected pairs of cylindrical rod electrodes to which both RF and DC voltages are applied. For a given RF frequency and at appropriate setting of the RF and DC voltages, only ions having a very limited range of mass to charge ratios will have stable trajectories through the quadrupole rod set mass filter. Accordingly, only ions having a certain mass to charge ratio will be transmitted by the quadrupole rod set mass filter. Ions having other mass to charge ratios will have unstable trajectories within the rod set mass filter and will collide with the cylindrical rod electrodes and hence become lost to the system.

Quadrupole rod set mass filters are particularly advantageous in that they can have resolutions of several thousand. However, disadvantageously, in order to operate effectively quadrupole rod set mass filters require that the ion beam which is to be mass filtered should have a relatively low energy. Quadrupole rod set mass filters also have a relatively limited mass to charge ratio range and must be manufactured and constructed to very high tolerances. Furthermore, quadrupole rod set mass filters suffer from the problem that the particular RF power supplies which are used with such mass filters are physically relatively large. This is particularly problematic when seeking to provide a compact bench-top mass spectrometer.

A Bradbury-Nielsen ion gate can be used as a mass filter. The ion gate may, for example, be provided in a flight region of a mass spectrometer wherein ions take different times to traverse the flight region depending upon their mass to charge ratio. The ion gate may be arranged so as only to allow ions having a relatively small range of mass to charge ratios to be transmitted. This is achieved by rapidly opening and then closing the electrostatic ion gate at a time equal to the arrival time of ions having mass to charge ratios of interest.

Bradbury-Nielsen ion gates comprise parallel electrodes between which an ion beam is directed. An electric field is created in use between the electrodes of the ion gate. The electric field, when created, is sufficient to deflect the beam of ions away from their original path and hence the ion gate can be considered to be closed or otherwise to have a transmission of 0% when an electric field is created. In order to open the gate or otherwise to provide a transmission of 100%, the electric field maintained between the electrodes is switched OFF or is otherwise reduced to zero for a very short period of time. This enables ions having a desired mass to charge ratio to pass through the ion gate without being deflected by an electric field. As soon as ions having the desired mass to charge ratio have been transmitted, the electric field is restored and ions subsequently arriving at the ion gate are deflected away from their original path.

In theory, the mass to charge ratio range of a Bradbury-Nielsen ion gate is unlimited. However, in practice, the resolution achievable with a Bradbury-Nielsen ion gate tends to be disappointingly low e.g. approximately 20-50 for dual-electrode arrangements and of the order of 100-200 for multi-electrode arrangements. The placement of electrodes very close to the path of an ion beam also tends to lead to a loss in ion transmission even when the ion gate is not being used as a mass filter since some ions will still tend to strike the electrodes. As a result, Bradbury-Nielsen ion gates are not commonly used as mass filters in commercial mass spectrometers.

Time of flight mass filters are also known which, like Wien filters, transmit all ions having a certain specific velocity. However, disadvantageously, ions having different mass to charge ratios but which happen to have substantially the same velocity will be simultaneously transmitted by such mass filters. This can be problematic in a number of different scenarios. For example, if a precursor or parent ion fragments (either spontaneously due to Post Source Decay or due to Collision Induced Dissociation in a collision or fragmentation cell), the resulting fragment ions will retain essentially the same velocity as the corresponding precursor or parent ion had. Accordingly, if a precursor or parent ion fragments upstream of a time of flight mass filter, then fragment ions together with corresponding unfragmented parent ions will be simultaneously transmitted by the time of flight mass filter. Accordingly, the time of flight mass filter will transmit ions having substantially different mass to charge ratios at substantially the same time.

It is therefore apparent that there are a number of problems associated with conventional mass filters.

It is therefore desired to provide an improved mass filter.

SUMMARY OF THE INVENTION

According to an aspect of the present invention there is provided a mass filter comprising:

one or more electrodes wherein, in use, one or more first voltage pulses are applied to the one or more electrodes in order to orthogonally accelerate at least some ions away from the one or more electrodes; and one or more ion mirrors for reflecting at least some ions which have been orthogonally accelerated such that the ions move generally towards a first or exit region of the mass filter;

wherein, in use, first ions having a desired mass or mass to charge ratio or having masses or mass to charge ratios within a first desired range are orthogonally decelerated or otherwise orthogonally retarded by one or more electric fields as the first ions approach the first or exit region of the mass filter.

The ions are preferably arranged to enter the mass filter substantially in an axial direction, the axial direction being substantially orthogonal to an orthogonal direction.

The one or more electrodes preferably comprise one or more pusher and/or puller electrodes for orthogonally accelerating the at least some ions in an orthogonal direction.

The one or more first voltage pulses preferably have an amplitude selected from the group consisting of: (i) <50 V; (ii) 50-100 V; (iii) 100-150 V; (iv) 150-200 V; (v) 200-250 V; (vi) 250-300 V; (vii) 300-350 V; (viii) 350-400 V; (ix) 400-450 V; (x) 450-500 V; (xi) 500-550 V; (xii) 550-600 V; (xiii) 600-650 V; (xiv) 650-700 V; (xv) 700-750 V; (xvi) 750-800 V; (xvii) 800-850 V; (xviii) 850-900 V; (xix) 900-950 V; (xx) 950-1000 V; (xxi) 1000-1050 V; (xxii) 1050-1100 V; (xxiii) 1100-1150 V; (xxiv) 1150-1200 V; (xxv) 1200-1250 V; (xxvi) 1250-1300 V; (xxvii) 1300-1350 V; (xxviii) 1350-1400 V; (xxix) 1400-1450 V; (xxx) 1450-1500 V; (xxxi) 1500-1550 V; (xxxii) 1550-1600 V; (xxxiii) 1600-1650 V; (xxxiv) 1650-1700 V; (xxxv) 1700-1750 V; (xxxvi) 1750-1800 V; (xxxvii) 1800-1850 V; (xxxviii) 1850-1900 V; (xxxix) 1900-1950 V; (xxxx) 1950-2000 V; and (xxxxi) >2000 V.

The one or more first voltage pulses preferably have a duration $t_{pulse}$, wherein $t_{pulse}$ is preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

The one or more first voltage pulses are preferably applied after a delay period having a duration $t_{start}$, wherein $t_{start}$ is preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

The delay period $t_{start}$ is preferably measured from when ions are first generated in an ion source or in an ion generating region.

The one or more first voltage pulses preferably comprise a square wave(s). However, according to other embodiments the one or more first voltage pulses may comprise voltage pulses having a linear, ramped, stepped, non-linear, sinusoidal or curved waveform or voltage profile.

According to the preferred embodiment ions entering the mass filter preferably have a non-zero component of velocity in an axial direction and preferably have a substantially zero component of velocity in an orthogonal direction. The orthogonal direction is preferably at 90° to the axial direction. At least some of the first ions are preferably orthogonally decelerated or otherwise orthogonally retarded by the one or more electric fields so as to have a substantially zero component of velocity in an orthogonal direction. Preferably, at least some of the first ions are orthogonally decelerated or otherwise orthogonally retarded by the electric field but maintain a substantially non-zero component of velocity in an axial direction.

At least some ions other than the first ions are preferably only partially orthogonally decelerated or otherwise only partially orthogonally retarded by one or more electric fields so that these ions preferably continue with a substantially non-zero component of velocity in an orthogonal direction. Preferably, at least some ions other than the first ions are only partially orthogonally decelerated or otherwise only partially orthogonally retarded by one or more electric fields but maintain a substantially non-zero component of velocity in an axial direction.

According to an embodiment at least some ions other than the first ions are not substantially orthogonally decelerated or otherwise orthogonally retarded so that the ions continue with a substantially non-zero component of velocity in an orthogonal direction. Preferably, at least some ions other than the first ions are not substantially orthogonally decelerated or otherwise orthogonally retarded so that the ions continue whilst maintaining a substantially non-zero component of velocity in an axial direction.

The first ions preferably have a mass to charge ratio or have mass to charge ratios falling within one or more ranges x, wherein x is selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

The first ions preferably exit the mass filter wherein, in use, ions other than the first ions are preferably substantially attenuated or lost within the mass filter. Preferably, at least some of the first ions exit the mass filter with a non-zero component of velocity in an axial direction. Preferably, at least some of the first ions exit the mass filter with a substantially zero component of velocity in an orthogonal direction.

The mass filter preferably comprises one or more flight regions arranged between the one or more electrodes and the one or more ion mirrors. One or more potential gradients are preferably maintained across at least a portion of the flight region as ions move from the one or more electrodes towards the one or more ion mirrors. The one or more potential gradients preferably act so as to further accelerate at least some ions towards the one or more ion mirrors. One or more potential gradients are preferably maintained across at least a portion of the flight region as ions move from the one or more ion mirrors towards the one or more electrodes. The one or more potential gradients preferably act so as to decelerate at least some ions as they approach the one or more electrodes.

According to a less preferred embodiment, at least a portion of the flight region may comprise one or more field free regions. Ions in the one or more field free regions are preferably neither accelerated nor decelerated as they move in the one or more field free regions towards the one or more ion mirrors. Ions in the one or more field free regions are also preferably neither accelerated nor decelerated as they move in the one or more field free regions from the one or more ion mirrors towards the one or more electrodes.

According to a preferred embodiment the one or more ion mirrors comprise one or more reflectrons. A linear or non-linear electric field gradient may be maintained within one or more of the reflectrons or ion mirrors.

Preferably, at least some second ions having undesired masses or mass to charge ratios having been reflected by the one or more ion mirrors approach the first or exit region of the mass filter and are reflected by one or more electric fields. At least some of the second ions are preferably reflected by the one or more electric fields into a flight region. Preferably, at least some of the second ions are reflected by the one or more electric fields away from the first or exit region of the mass filter.

The second ions preferably include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

According to the preferred embodiment at least some third ions having undesired masses or mass to charge ratios having been reflected by the one or more ion mirrors approach the first or exit region of the mass filter and are only partially orthogonally decelerated or otherwise only partially orthogonally retarded. At least some of the third ions preferably continue through the first or exit region of the mass filter.

Preferably, at least some of the third ions do not exit from the mass filter. According to the preferred embodiment at least some of the third ions impinge upon the one or more electrodes.

Preferably, at least some of the third ions are substantially attenuated or lost within the mass filter.

The third ions preferably include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

According to an embodiment at least some fourth ions having masses or mass to charge ratios within a fourth range pass through the mass filter without being orthogonally accelerated whilst at least some other ions having different masses or mass to charge ratios are orthogonally accelerated. The fourth ions preferably include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

At least some of the fourth ions are preferably onwardly transmitted to the exit of the mass filter and preferably emerge or are emitted from the mass filter.

According to an embodiment, at least some fifth ions having masses or mass to charge ratios within a fifth range pass through the mass filter without being orthogonally accelerated whilst at least some other ions having different masses or mass to charge ratios are orthogonally accelerated. Preferably, the fifth ions have a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

At least some of the fifth ions are preferably onwardly transmitted to the exit of the mass filter and preferably emerge or are emitted from the mass filter.

According to an embodiment at least some sixth ions having masses or mass to charge ratios within a sixth range are orthogonally accelerated substantially immediately upon entering the mass filter. At least some of the sixth ions are preferably arranged to collide with a plate or electrode forming part of the entrance region of the mass filter. At least some of the sixth ions are preferably substantially attenuated or lost within the mass filter. The sixth ions preferably include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

According to an embodiment one or more second voltage pulses are applied, in use, to the one or more electrodes prior to the one or more first voltage pulses. The one or more second voltage pulses preferably have a duration $t(1)_{ON}$, wherein $t(1)_{ON}$ is preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

The voltage applied to the one or more electrodes is preferably reduced for a period of time $t(1)_{OFF}$ after the one or more second voltage pulses are applied to the one or more electrodes and prior to the one or more first voltage pulses. Preferably, $t(1)_{OFF}$ is selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

According to an embodiment at least some seventh ions having masses or mass to charge ratios within a seventh range are orthogonally accelerated substantially immediately upon entering the mass filter. At least some of the seventh ions are preferably arranged to collide with a plate or electrode forming part of the entrance region of the mass filter. Preferably, at least some of the seventh ions are substantially attenuated or lost within the mass filter. The seventh ions preferably include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

One or more third voltage pulses are preferably applied, in use, to the one or more electrodes subsequent to the one or more first voltage pulses. The one or more third voltage pulses preferably have a duration $t(2)_{ON}$, wherein $t(2)_{ON}$ is preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

The voltage applied to the one or more electrodes is preferably reduced for a period of time $t(2)_{OFF}$ after the one or more first voltage pulses are applied to the one or more electrodes and prior to the one or more third voltage pulses being applied to the one or more electrodes. Preferably, $t(2)_{OFF}$ is selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

A preferred feature of the present invention is that the first ions preferably have a first range of angular divergence $\Delta\theta_1$ immediately prior to or upon entering the mass filter. Preferably, the first ions have a second range of angular divergence $\Delta\theta_2$ immediately prior to or upon exiting the mass filter. The ratio of the first range of angular divergence to the second range of angular divergence $\Delta\theta_1/\Delta\theta_2$ is preferably selected from the group consisting of (i) >1; (ii) 1-1.1; (iii) 1.1-1.2; (iv) 1.2-1.3; (v) 1.3-1.4; (vi) 1.4-1.5; (vii) 1.5-1.6; (viii) 1.6-1.7; (ix) 1.7-1.8; (x) 1.8-1.9; (xi) 1.9-2.0; and (xii) >2.

According to an aspect of the present invention there is provided a mass spectrometer comprising a mass filter as described above.

The mass spectrometer preferably comprising an ion source arranged upstream of the mass filter. The ion source is preferably selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Laser Desorption Ionisation ("LDI") ion source; (v) an Inductively Coupled Plasma ("ICP") ion source; (vi) an Electron Impact ("EI") ion source; (vii) a Chemical Ionisation ("CI") ion source; (viii) a Field Ionisation ("FI") ion source; (ix) a Fast Atom Bombardment ("FAB") ion source; (x) a Liquid Secondary Ion Mass Spectrometry ("LSIMS") ion source; (xi) an Atmospheric Pressure Ionisation ("API") ion source; (xii) a Field Desorption ("FD") ion source; (xiii) a Matrix Assisted Laser Desorption Ionisation ("MALDI") ion source; (xiv) a Desorption/Ionisation on Silicon ("DIOS") ion source; and (xv) a Desorption Electrospray Ionisation ("DESI") ion source.

The ion source may comprises a continuous ion source or a pulsed ion source. The mass spectrometer preferably further comprises a mass analyser which is preferably arranged downstream of the mass filter. The mass analyser is preferably selected from the group consisting of: (i) an orthogonal acceleration Time of Flight mass analyser; (ii) an axial acceleration Time of Flight mass analyser; (iii) a quadrupole mass analyser; (iv) a Penning mass analyser; (v) a Fourier Transform Ion Cyclotron Resonance ("FTICR") mass analyser; (vi) a 2D or linear quadrupole ion trap; (vii) a Paul or 3D quadrupole ion trap; and (viii) a magnetic sector mass analyser.

According to another aspect of the present invention there is provided a device for reducing the angular divergence of a beam of ions, the device comprising:

one or more electrodes wherein, in use, one or more first voltage pulses are applied to the one or more electrodes in order to orthogonally accelerate at least some ions away from the one or more electrodes; and one or more ion mirrors for reflecting at least some ions which have been orthogonally accelerated such that the ions move generally towards a first or exit region of the mass filter;

wherein, in use, first ions having a desired mass or mass to charge ratio or having masses or mass to charge ratios within a first desired range are orthogonally decelerated or otherwise orthogonally retarded by one or more electric fields as the first ions approach the first or exit region of the mass filter.

Further embodiments of the device are contemplated wherein the device comprises the same components of the mass filter as described above.

According to another aspect of the present invention there is provided a method of mass filtering ions comprising:

providing one or more electrodes;

applying one or more first voltage pulses to the one or more electrodes in order to orthogonally accelerate at least some ions away from the one or more electrodes;

reflecting at least some ions which have been orthogonally accelerated such that the ions move generally towards a first or exit region of the mass filter; and orthogonally decelerating or otherwise orthogonally retarding by means of one or more electric fields first ions having a desired mass or mass to charge ratio or having masses or mass to charge ratios within a first desired range as the first ions approach the first or exit region of the mass filter.

According to another aspect of the present invention there is provided a method of reducing the angular divergence of a beam of ions comprising:

providing one or more electrodes;

applying one or more first voltage pulses to the one or more electrodes in order to orthogonally accelerate at least some ions away from the one or more electrodes;

reflecting at least some ions which have been orthogonally accelerated such that the ions move generally towards a first or exit region of the mass filter; and orthogonally decelerating or otherwise orthogonally retarding by means of one or more electric fields first ions having a desired mass or mass to charge ratio or having masses or mass to charge ratios within a first desired range as the first ions approach the first or exit region of the mass filter.

According to another aspect of the present invention there is provided a device wherein in a first mode of operation the device acts as a mass filter wherein ions having a desired mass to charge ratio are orthogonally accelerated so as to have a non-zero component of velocity in an orthogonal direction and are then orthogonally decelerated so as to have a substantially zero component of velocity in the orthogonal direction.

Preferably, in the first mode of operation ions having undesired mass to charge ratios are orthogonally accelerated so as to have a non-zero component of velocity in the orthogonal direction and are then only partially orthogonally decelerated such that they continue to possess a non-zero component of velocity in the orthogonal direction.

The device may also be operated in a second mode of operation wherein the device operates in a non-mass filtering mode of operation i.e. ions are not mass filtered. In the second mode of operation the device preferably transmits to an exit of the device at least 50%, 55%, 60%, 65%, 70%, 75%, 80%, 85%, 90%, 95%, 99% or substantially 100% of the ions received at an entrance to the device.

According to another aspect of the present invention there is provided a method comprising operating a device in a first mode of operation in order to act as a mass filter, wherein in the first mode of operation the method comprises:

orthogonally accelerating ions having a desired mass to charge ratio such that the ions have a non-zero component of velocity in an orthogonal direction; and then orthogonally decelerating the ions such that they possess a substantially zero component of velocity in the orthogonal direction.

Preferably, in the first mode of operation the method further comprises orthogonally accelerating ions having undesired mass to charge ratios such that the ions non-zero components of velocity in the orthogonal direction and then only partially orthogonally decelerating the ions such that they continue to possess a non-zero component of velocity in the orthogonal direction.

The preferred embodiment relates to a new type of mass filter. The preferred mass filter differs from known time of flight mass filters in that the preferred mass filter does not utilise the axial velocity of ions in order to isolate or otherwise select ions having a particular mass to charge ratio. Instead, the mass filter according to the preferred embodiment preferably orthogonally accelerates (i.e. accelerates ions in an orthogonal direction which is substantially 90° to the initial axial direction of the ions) ions out of a primary acceleration region and into a flight region. The ions preferably travel towards and then enter an ion mirror. The ion mirror preferably reflects the ions back into the flight region and back towards the primary acceleration region. The ions are preferably partially decelerated after having been reflected by the ion mirror as they pass through the flight region towards the primary acceleration region. Ions which return to the primary acceleration region at a certain precise time are preferably arranged to be further orthogonally decelerated or retarded by a time varying electric field maintained across a portion of the primary acceleration region. Ions having a desired mass to charge ratio are preferably retarded or otherwise orthogonally decelerated such that their component of velocity in an orthogonal direction is preferably reduced to substantially zero whilst their component of velocity in an axial direction preferably remains substantially non-zero. The selected ions are then preferably emitted and onwardly transmitted from the mass filter. Since the mass filtering mode of operation of the preferred mass filter preferably does not depend upon the axial velocity of the ions, then the preferred mass filter is preferably substantially unaffected by the initial axial, spatial, energy and time distributions of the ions which are to be mass filtered. The preferred mass filter is therefore particularly advantageous compared to known mass filters.

The preferred mass filter may, in one embodiment, orthogonally accelerate ions out of the primary acceleration region by the application of a preferably relatively long, preferably relatively high voltage pulse to one or more orthogonal acceleration electrodes arranged in the primary acceleration region. Accordingly, all ions in an ion beam will gain essentially the same energy. The ions are then preferably accelerated towards an ion mirror and are then reflected back towards the primary acceleration region by the ion mirror. As ions having the desired mass to charge ratio approach the primary acceleration region, these particular ions are then preferably fully orthogonally decelerated by arriving at the primary acceleration region at a precise time when the high voltage pulse which initially orthogonally accelerated the ions is now falling from a maximum voltage to zero in a finite period of time. By switching the voltage pulse applied to the one or more orthogonal acceleration electrodes OFF at a certain precise time, ions having a certain mass to charge ratio arriving at the primary acceleration region will experience a deceleration in the orthogonal direction of substantially the same magnitude as the magnitude of the orthogonal acceleration which the ions initially experienced. Accordingly, ions having a certain desired mass to charge ratio will have their component of velocity in the orthogonal direction reduced back to zero and hence will return to their original axial path through the mass filter.

Ions having a particular mass to charge ratio are therefore preferably selected by the accurate timing of the length or duration of one or more preferably relatively high voltage pulses applied to one or more orthogonal acceleration electrodes preferably arranged in a primary acceleration region of the mass filter. Whilst ions having a desired mass to charge ratio will preferably be onwardly transmitted by the mass filter, ions having a relatively smaller mass to charge ratio are preferably arranged such that they are reflected by the ion mirror and arrive at the primary acceleration region at a time when the one or more orthogonal acceleration electrodes are still being energised by the application of a voltage pulse to the one or more primary acceleration electrodes. The ions therefore arrive at a time when an electric field is present in the primary acceleration region. The electric field will cause the ions having a relatively small mass to charge ratio to be orthogonally decelerated, reflected and then orthogonally re-accelerated back into the flight region. Such ions will then preferably become lost to the system.

Ions having a relatively high mass to charge ratio are preferably arranged to arrive at the primary acceleration region (having been reflected by the ion mirror) at a time when the one or more orthogonal acceleration electrodes are preferably no longer being energised i.e. when no voltage pulse is preferably being applied to the one or more orthogonal acceleration electrodes. The ions will therefore preferably arrive at the primary acceleration region at a time when no electric field is present in the primary acceleration region. Accordingly, ions having a relatively high mass to charge ratio, although partially decelerated in an orthogonal direction as the ions pass back through the flight region towards the primary acceleration region are not further or completely orthogonally decelerated in the primary acceleration region. As a result, these ions will continue to travel with a non-zero component of velocity in an orthogonal direction and hence are not returned to having a purely axial component of velocity. According to an embodiment such ions may be arranged to collide with one of the orthogonal acceleration electrodes or another part of the mass filter and hence become lost to the system.

The preferred mass filter has a number of advantages compared with known mass filters. Since the preferred mass filter does not select ions having a particular mass to charge ratio based upon the axial velocity of ions, then axial energy distributions and time distributions preferably do not adversely effect the operation of the preferred mass filter. As a result, undesired fragment ions resulting from a dissociation event after corresponding parent ions have been accelerated to their final energy or velocity preferably are advantageously not onwardly transmitted by the preferred mass filter unlike conventional time of flight mass filters. Another advantage of the preferred mass filter is that the preferably high voltage pulse(s) applied to the one or more orthogonal acceleration electrodes preferably do not require very fast rise and/or fall times and hence complex and expensive fast electronic voltage supplies are not required.

When the mass filter is not in use or is otherwise arranged to act as an ion guide with a high (e.g. 100%) ion transmission in a non-mass filtering mode of operation, no electrodes are present sufficiently close to the path of an ion beam passing through the mass filter as to interfere with the ion beam. Since ions will not therefore collide with any electrodes in the mass filter, the mass filter preferably will have a substantially 100% ion transmission efficiency when used as an ion guide in a non-mass filtering mode of operation. This is not the case with other known mass filters such as Bradbury-Nielson ion gates wherein ions can collide with the electrodes which form the ion gate, and hence such ion gates typically have an ion transmission efficiency <100% when used in a non-mass filtering mode of operation.

Another advantage of the preferred mass filter is that by correctly timing the length and/or duration of one or more high voltage pulse(s) applied to the one or more orthogonal acceleration electrodes, it is possible to reduce the divergence of an ion beam being mass filtered by the mass filter and hence the preferred mass filter advantageously focuses an ion beam. The mass filter can therefore be used to increase the transmission of ions through subsequent stages of a mass spectrometer which are preferably arranged downstream of the preferred mass filter.

DESCRIPTION OF THE DRAWINGS

Various embodiments of the present invention will now be described, by way of example only, and with reference to the accompanying drawings in which.

DETAILED DESCRIPTION OF THE DRAWINGS

Figure 1A:
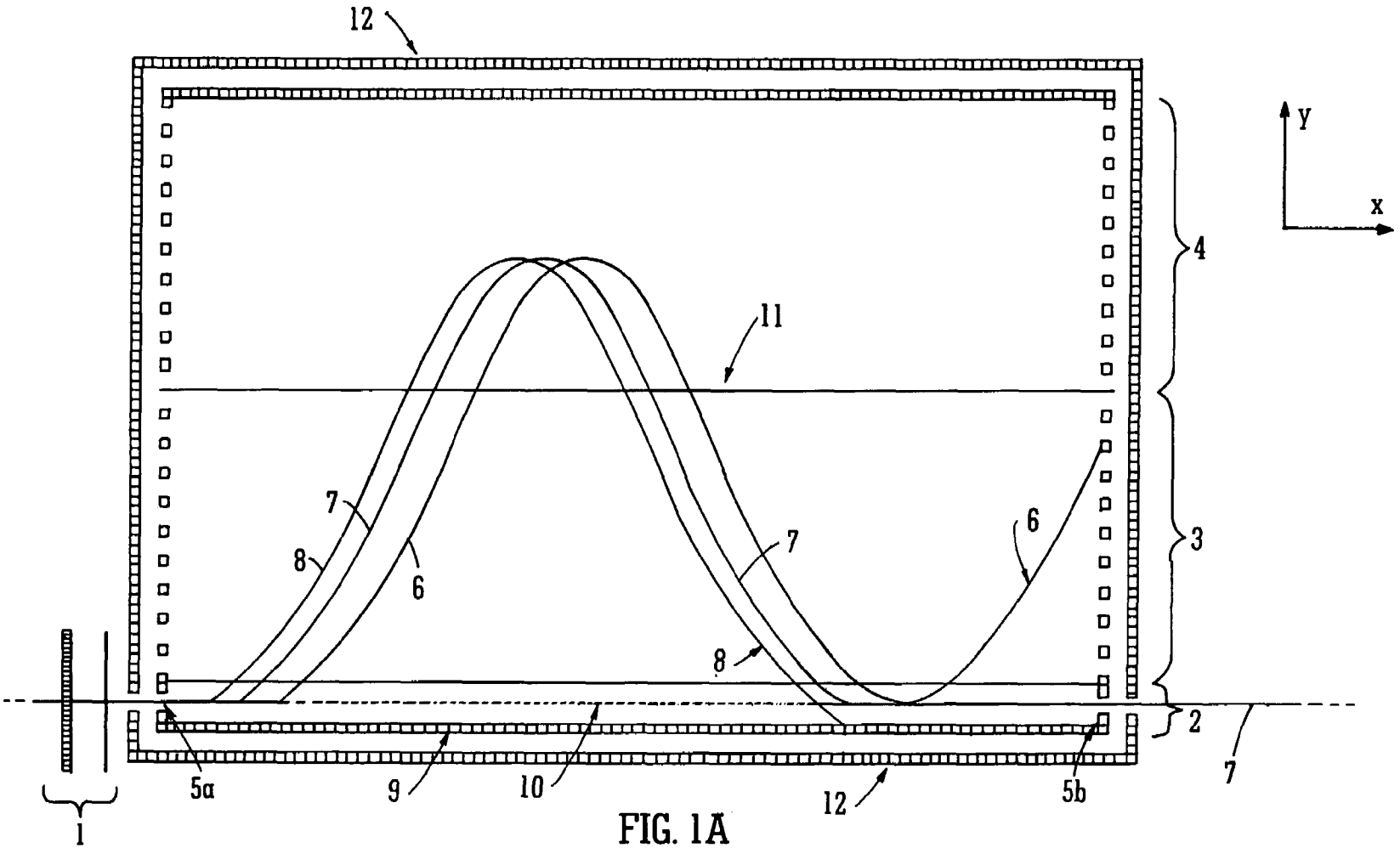
FIG. 1A shows a SIMION (RTM) simulation of three ions having different mass to charge ratios being orthogonally accelerated by a mass filter according to a first embodiment.

A preferred embodiment of the present invention will now be described with reference to FIG. 1A. FIG. 1A shows a SIMION (RTM) simulation of a mass filter according to a preferred embodiment. An ion source 1 is shown arranged upstream of a mass filter according to a preferred embodiment. The mass filter comprises an entrance aperture 5*a*, a primary acceleration region 2 including one or more orthogonal acceleration electrodes 9, a flight region 3 arranged adjacent to the primary acceleration region 2, an ion mirror or reflectron 4 (arranged to receive ions exiting from the flight region 3 and to reflect them back into the flight region 3) and an exit aperture 5*b*. The mass filter was modelled by theoretically surrounding the mass filter in a grounded chamber 12 in order to mimic the effects of a vacuum chamber. It will be appreciated, however, that the grounded chamber 12 is merely provided and shown for purposes of modelling the passage of ions through the mass filter in the simulation and is not actually required in a real mass filter according to the preferred embodiment.

The trajectories of three ions 6,7,8 having different mass to charge ratios were simulated as they entered and passed through the mass filter. The three ions 6,7,8 had mass to charge ratios of 1000, 1500 and 2000 respectively. The respective trajectories of the ions 6,7,8 through the mass filter are shown in FIG. 1A. An axial or x-direction is shown which is preferably at 90° to an orthogonal or y-direction.

The three ions 6,7,8 in the simulation were modelled as being accelerated from +500 V to 0 V in the region of the ion source 1. At a time 2.5 μs after the ions 6,7,8 had been emitted from or otherwise generated in the ion source 1, a +750 V voltage pulse having a duration of 8.374 μs was applied to the one or more orthogonal acceleration electrodes 9 arranged in the primary acceleration region 2. The voltage pulse applied to the one or more orthogonal acceleration electrodes 9 had the effect of raising the potential of the one or more orthogonal acceleration electrodes 9 from 0 V to +750 V for a time period of 8.374 μs. The voltage pulse applied to the one or more orthogonal acceleration electrodes 9 thus had the effect of generating an electric field which orthogonally accelerated the ions 6,7,8 out of the primary acceleration region 2 and into the adjacent flight region 3. The applied voltage pulse in the embodiment shown and described in relation to FIGS. 1A-1C was modelled as having a rise time of 50 ns i.e. it took 50 ns for the potential of the one or more orthogonal acceleration electrodes 9 to increase or rise from 0 V to +750 V. Similarly, the applied voltage pulse was modelled as having a fall time of 50 ns i.e. it took 50 ns for the potential of the one or more orthogonal acceleration electrodes 9 to fall or reduce from +750 V to 0 V.

Figure 1B:
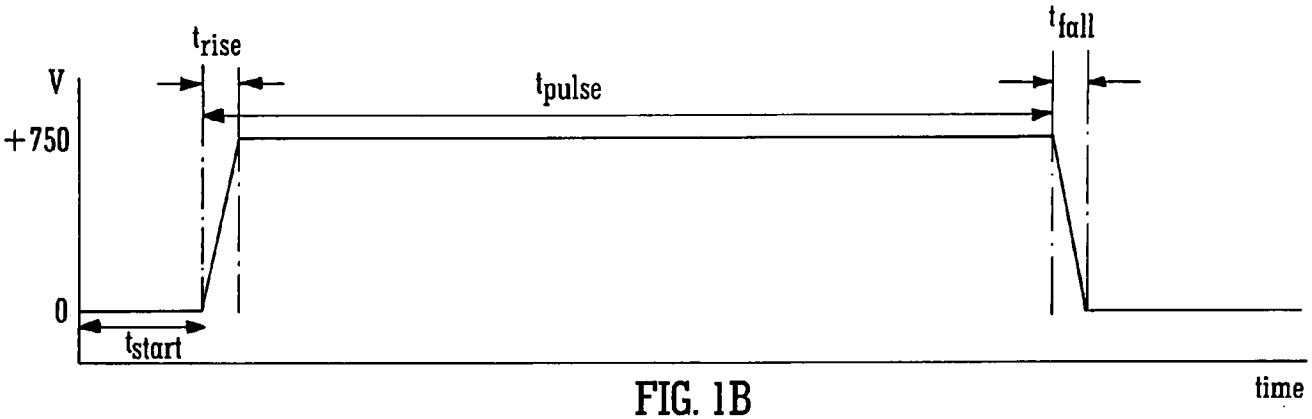
FIG. 1B shows a corresponding voltage timing diagram illustrating the delay time and pulse duration of a high voltage pulse applied to an orthogonal acceleration electrode of a preferred mass filter and FIG. 1C shows a corresponding potential energy diagram illustrating the potential gradient maintained across the primary acceleration region, flight region and within the ion mirror during and after an orthogonal acceleration pulse is applied to one or more orthogonal acceleration electrodes in the primary acceleration region.

FIG. 1B shows a voltage timing diagram showing the timing of a high voltage pulse applied to the one or more orthogonal acceleration electrodes 9 according to a preferred embodiment. The high voltage pulse was applied to the one or more orthogonal acceleration electrodes 9 after a certain delay time $t_{start}$ after the formation, generation or release of ions from the ion source 1 or an ion generating region otherwise arranged upstream of the mass filter. For the particular simulation shown in FIG. 1A the delay time $t_{start}$ was 2.5 μs. The rise time $t_{rise}$ and the fall time $t_{fall}$ were 50 ns. The duration $t_{pulse}$ of the relatively high voltage pulse is preferably taken to be the time ($t_{rise}$) for the voltage pulse to rise or increase from zero to a maximum voltage and then to remain at this maximum voltage without reducing in amplitude. In the particular embodiment shown and described with reference to FIGS. 1A-1C, the voltage pulse had a duration $t_{pulse}$ of 8.374 μs.

It will be appreciated that the delay time $t_{start}$, rise time $t_{rise}$, voltage pulse duration $t_{pulse}$, fall time $t_{fall}$ and the amplitude of the voltage pulse applied to the one or more orthogonal acceleration electrodes 9 may vary and differ from the embodiment described with reference to FIGS. 1A-1C depending upon the mass to charge ratio of ions to be selected and the overall geometry of the mass filter. It will also be appreciated that the voltage pulse may have a negative polarity and that the one or more orthogonal acceleration electrodes 9 may be maintained at a potential above or below 0 V when a voltage pulse is not applied to the one or more orthogonal acceleration electrodes 9. A person skilled in the art will also appreciate that the absolute voltages at which the one or more orthogonal acceleration electrodes 9 are maintained is less important than the fact that there is a relative change in the potential at which the one or more orthogonal acceleration electrodes 9 are maintained in use.

Figure 1C:
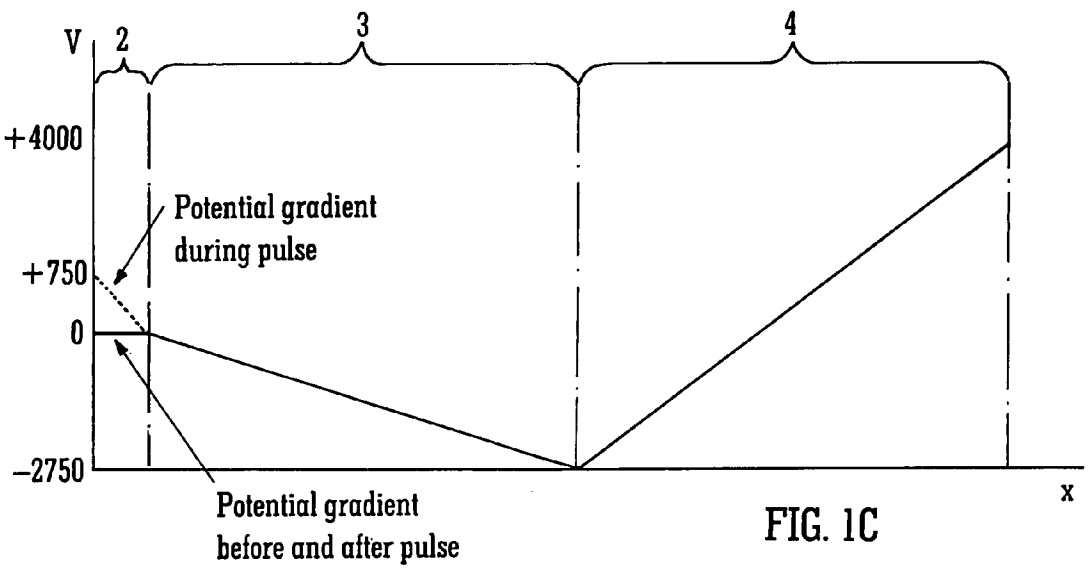

The flight region 3 according to the preferred embodiment is preferably not a field free region but rather as can be seen from FIG. 1C preferably comprises a region wherein ions which have been orthogonally accelerated out of the primary acceleration region 2 are preferably further orthogonally accelerated due to a non-zero potential gradient being maintained across the flight region 3 as the ions pass through the flight region 3 towards the ion mirror or reflectron 4. The three ions 6,7,8 modelled in FIG. 1A are therefore preferably further orthogonally accelerated (i.e. accelerated in the y-direction shown in FIG. 1A) upon entering the flight region 3 towards the entrance of the ion mirror or reflectron 4. The ion mirror or reflectron 4 is preferably arranged adjacent to the flight region 3 and preferably receives ions exiting the flight region 3. The ion mirror or reflectron 4 preferably reflects the ions 6,7,8 back into the flight region 3 and hence preferably directs the ions 6,7,8 back towards the primary acceleration region 2 and in the general direction of the exit or exit region of the mass filter. However, other embodiments are contemplated wherein ions may be arranged to exit the mass filter in a different manner to that shown in FIG. 1A by, for example, being further deflected within the mass filter.

In the particular embodiment shown and described above with relation to FIGS. 1A-1C, the entrance region of the ion mirror or reflectron 4 (or the electrodes forming the entrance region or portion of the ion mirror or reflectron 4) are preferably held or maintained at a potential of −2750 V. The rearmost region or portion of the ion mirror or reflectron 4

(or the electrodes of the ion mirror or reflectron 4 located at the rearmost region of the ion mirror or reflectron 4) are preferably held at a potential of +4000 V. Electrodes located within the ion mirror or reflectron 4 between the entrance region and the rearmost region of the ion mirror or reflectron 4 are preferably held or maintained at intermediate potentials between −2750 V and +4000 V. The profile of the potential gradient maintained within the ion mirror or reflectron 4 is shown for ease of illustration as being linear in FIG. 1C. However, in practice and/or according to other embodiments, the potential gradient within the ion mirror or reflectron 4 may comprise a stepped, curved, exponential or otherwise non-linear potential gradient profile.

Once the ions 6,7,8 enter the ion mirror or reflectron 4, the ions 6,7,8 are preferably subjected to a retarding potential field within the ion mirror or reflectron 4 such that the ions 6,7,8 are reflected within the ion mirror or reflectron 4. The ions 6,7,8 will then preferably exit the ion mirror or reflectron 4 such that they then re-enter the flight region 3. The ions 6,7,8 upon re-entering the flight region 3 then preferably pass back through the flight region 3 as they head towards the primary acceleration region 2 and the general direction of the exit of the mass filter. As the ions 6,7,8 pass back through the flight region 3 having been reflected by the ion mirror and reflectron 4, the ions 6,7,8 are preferably partially orthogonally decelerated in the y-direction only by the retarding potential gradient which is preferably maintained across the flight region 3. The potential gradient maintained across the flight region which served to initially further orthogonally accelerate the ions 6,7,8 when they were travelling from the primary acceleration region 2 towards the ion mirror or reflectron 4, now therefore preferably serves to partially orthogonally decelerate the ions 6,7,8 as they head back towards the primary acceleration region 2. The axial component of velocity of the ions 6,7,8 preferably remains substantially the same throughout the primary acceleration region 2, flight region 3 and ion mirror 4. The partially orthogonally decelerated ions 6,7,8 then preferably re-enter the primary acceleration region 2 as can be seen more clearly with reference to FIG. 1A.

The voltage pulse applied to the one or more orthogonal acceleration electrodes 9 preferably has an amplitude of +750 V and a duration of 8.374 μs. The potential of the one or more orthogonal acceleration electrodes 9 then preferably returns to 0 V (or less preferably to another different potential or voltage) at the end of the voltage pulse duration.

The application of the relatively high voltage pulse to the one or more orthogonal acceleration electrodes 9 preferably affects the ions 6,7,8 having different mass to charge ratios in different ways. Ions 6 having the lowest mass to charge ratio of 1000 will preferably have travelled further into the entrance region of the mass filter than the ions 7,8 having higher mass to charge ratios of 1500 and 2000 when the voltage pulse is applied to the one or more orthogonal acceleration electrodes 9. Ions 6 having the lowest mass to charge ratio of 1000 will also have the fastest flight time through the flight region 3 once they have been orthogonally accelerated. Accordingly, ions 6 having a mass to charge ratio of 1000 will exit the flight region 3 having been reflected by the ion mirror or reflectron 4 and will arrive at the primary acceleration region 2 before other ions 7,8 which have comparatively higher mass to charge ratios.

The duration of the high voltage pulse applied to the one or more orthogonal acceleration electrodes 9 is preferably such that ions 6 having a mass to charge ratio of 1000 will preferably exit the flight region 3 and arrive at the primary acceleration region 2 at a time when the one or more orthogonal acceleration electrodes 9 are still preferably being energised by the +750 V voltage pulse. Accordingly, ions 6 having a mass to charge ratio of 1000 which approach the primary acceleration region 2 having been reflected by the ion mirror on reflectron 4 will preferably be orthogonally decelerated or retarded but will then also be reflected back out into the flight region 3 by the electric field maintained across the primary acceleration region 2. Upon re-entering the flight region 3 the ions 6 having a mass to charge ratio of 1000 are preferably allowed or arranged to become lost to the system by, for example, colliding with a part of the mass filter.

Ions 8 having the highest mass to charge ratio of 2000 will have the slowest flight time through the flight region 3. The duration of the high voltage pulse applied to the one or more orthogonal acceleration electrodes 9 is preferably such that ions 8 having a mass to charge ratio of 2000 will preferably exit the flight region 3 and arrive at the primary acceleration region 2 at a time when the one or more orthogonal acceleration electrodes 9 are preferably no longer being energised by the high voltage pulse i.e. when the one or more orthogonal acceleration electrodes 9 are preferably maintained at 0 V (or some other potential or voltage). Accordingly, although ions 8 having a mass to charge ratio of 2000 will have been partially orthogonally decelerated or retarded as they pass from the ion mirror or reflectron 4 back through the flight region 3, the ions 8 will not experience any further orthogonal deceleration or orthogonal retardation in the orthogonal or y-direction in the primary acceleration region 2. This is because at the time when the ions 8 arrive at the primary acceleration region 2 the potential gradient across the primary acceleration region 2 will preferably be substantially zero. Accordingly, the ions 8 will therefore possess a non-zero component of velocity in the orthogonal or y-direction as they enter and pass through the primary acceleration region 2. These ions 8 will therefore preferably continue through the primary acceleration region 2 before preferably colliding with either one of the orthogonal acceleration electrodes 9 or with another part of the mass filter. The ions 8 are therefore preferably arranged or allowed to become lost to the system.

The duration of the relatively high voltage pulse applied to the one or more orthogonal acceleration electrodes 9 is preferably such that ions 7 having a mass to charge ratio of 1500 are arranged to have a flight time through the flight region 3 such that when the ions 7 exit the flight region 3 having been reflected by the ion mirror 4 and approach the primary acceleration region 2, the potential gradient maintained across the primary acceleration region 2 will preferably begin to vary (i.e. decrease) with time as the ions 7 further approach the primary acceleration region 2. Since the voltage pulse applied to the one or more orthogonal acceleration electrodes 9 preferably has a finite fall time (e.g. 50 ns according to the preferred embodiment), then a retarding potential gradient will preferably be maintained across the primary acceleration region 2 which will reduce in intensity or amplitude to preferably zero (or less preferably to a low value) over the finite fall time of the voltage pulse applied to the one or more orthogonal acceleration electrodes 9. Accordingly, ions 7 having a mass to charge ratio of 1500 are preferably arranged to experience a retarding impulse or orthogonal deceleration in the orthogonal or y-direction only in the primary acceleration region 2 which will have precisely the opposite effect to the accelerating impulse or orthogonal acceleration which originally orthogonally accelerated the ions 6,7,8 into the flight region 3. As a result of receiving an equal and opposite impulse to the impulse which originally orthogonally accelerated the ions 6,7,8 into the flight region 3, the ions 7 having a mass to charge ratio of 1500 will preferably have their component of velocity in an orthogonal or y-direction preferably reduced to zero (or less preferably to near zero) and hence will be returned to their original, preferably axial, path or heading 10 through the mass filter as indicated by the x-direction in FIG. 1A. The result of the decelerating impulse is therefore preferably that the orthogonal component of velocity of the desired ions 7 having a mass to charge ratio of 1500 is reduced to zero (or less preferably to near zero) whilst the component of velocity of the desired ions 7 in an axial or x-direction is preferably unaffected. The desired ions 7 therefore preferably return to having a purely axial component of velocity. The ions 7 having a desired mass to charge ratio will then preferably exit the mass filter, preferably but not necessarily in an axial or x-direction, via an exit aperture 5*b* which preferably forms part of a downstream portion of the mass filter. A beam of ions 7 corresponding to ions 7 is shown in FIG. 1A exiting the mass filter.

FIG. 1C illustrates the potential gradient maintained across the primary acceleration region 2, the flight region 3 and the ion mirror 4 according to a preferred embodiment of the present invention. According to this embodiment the primary acceleration region 2 is preferably initially maintained at 0 V. The one or more orthogonal acceleration electrodes 9 are then preferably pulsed from 0 V to +750 V so that a 750 V potential gradient is preferably maintained across the primary acceleration region 2. This potential gradient preferably causes ions 6,7,8 to be substantially orthogonally accelerated in the orthogonal or y-direction out from the primary acceleration region 2 and into the flight region 3. The ions 6,7,8 having passed into the flight region 3 are then preferably further orthogonally accelerated in the orthogonal or y-direction as they pass through the flight region 3 due to an accelerating potential gradient which is preferably maintained across the flight region 3.

The ions 6,7,8 then preferably reach the ion mirror 4, whereupon the ions 6,7,8 are then preferably decelerated within the ion mirror 4. The ions 6,7,8 are then preferably reflected and accelerated out of the ion mirror 4 such that the ions 6,7,8 preferably re-enter the flight region 3. As the ions 6,7,8 re-enter the flight region 3, the ions 6,7,8 preferably experience the same potential gradient which had previously further orthogonally accelerated them towards the ion mirror 4. However, the potential gradient maintained across the flight region 3 now acts to partially retard or partially orthogonally decelerate the ions 6,7,8 in the orthogonal or y-direction. The ions 6,7,8 having been partially orthogonally decelerated in the orthogonal or y-direction then preferably exit the flight region 3 and re-enter the primary acceleration region 2. The duration of the high voltage pulse applied to the one or more orthogonal acceleration electrodes 9 is preferably such that ions having a desired mass to charge ratio experience in the primary acceleration region 2 a retarding potential gradient which rapidly decreases with time or an impulse such that the ions having a desired mass to charge ratio are further orthogonally decelerated until or such that their component of velocity in the orthogonal or y-direction is preferably reduced to zero. Ions having a desired mass to charge ratio will therefore preferably be arranged to end up having a non-zero axial (or x-direction) component of velocity and preferably a substantially zero orthogonal (or y-direction) component of velocity in the primary acceleration region 2. Less preferred embodiments are contemplated wherein the desired ions which are emitted or which emerge from the mass filter may have a non-zero component of velocity in the orthogonal direction if, for example, the desired ions are then further deflected and/or accelerated and/or decelerated within the mass filter.

According to the particular embodiment shown and described with reference to FIGS. 1A-1C, ions irrespective of their mass to charge ratio will preferably be orthogonally accelerated into the flight region 3 but only ions having a desired mass to charge ratio will preferably have their orthogonal component of velocity reduced to zero and hence will preferably emerge from the mass filter and be onwardly transmitted therefrom.

A variation of the embodiment shown and described with reference to FIGS. 1A-1C will now be described with reference to FIGS. 2A and 2B. According to this second embodiment, the ion source 1 is preferably located further away from the mass filter than in the first embodiment shown and described with reference to FIGS. 1A-1C. The extended region between the ion source 1 and the mass filter preferably acts as an additional flight region such that ions emitted from the ion source 1 will preferably arrive at the entrance to the mass filter at different times depending upon their mass to charge ratio i.e. ions will preferably become temporally separated or dispersed according to their mass to charge ratio as they pass from the ion source 1 to the entrance of the mass filter.

Figure 2A:
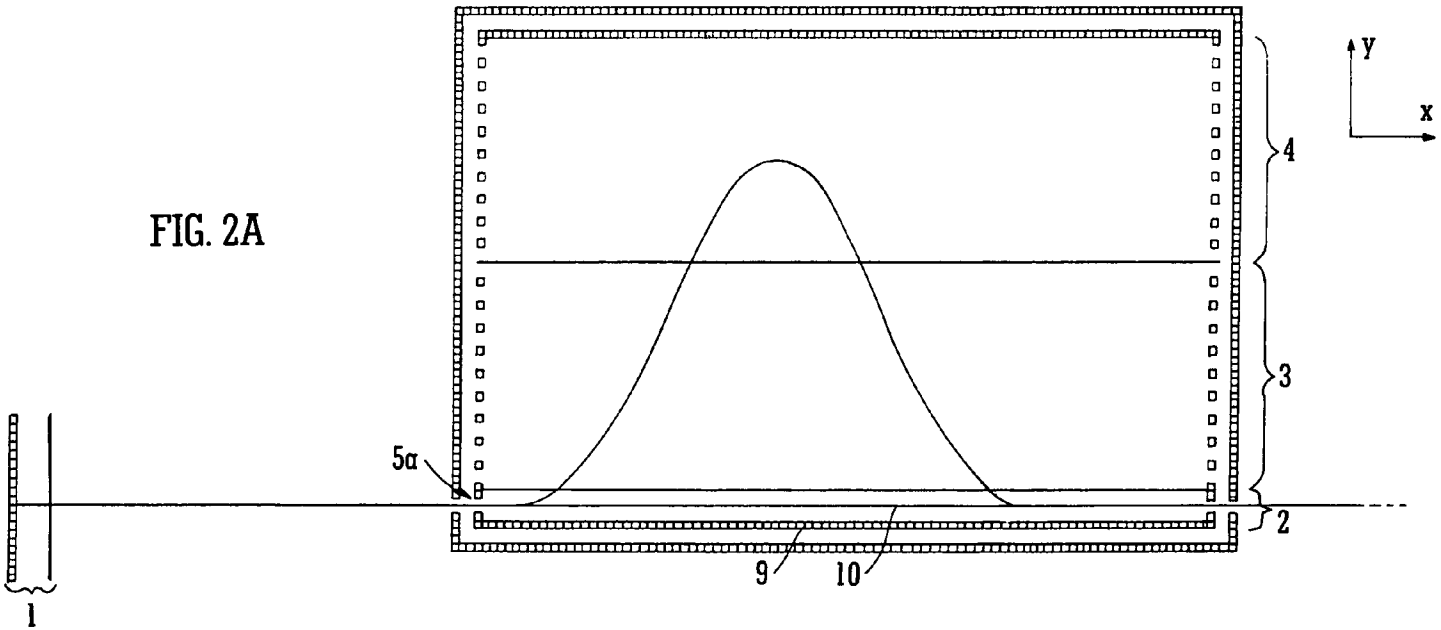
FIG. 2A shows a SIMION (RTM) simulation of a second embodiment wherein ions having relatively low and relatively high mass to charge ratios are not orthogonally accelerated by the mass filter but instead pass straight through the mass filter and FIG. 2B shows a corresponding voltage timing diagram illustrating the delay time and pulse duration of a high voltage pulse applied to an orthogonal acceleration electrode of a mass filter according to the second embodiment.
Figure 2B:
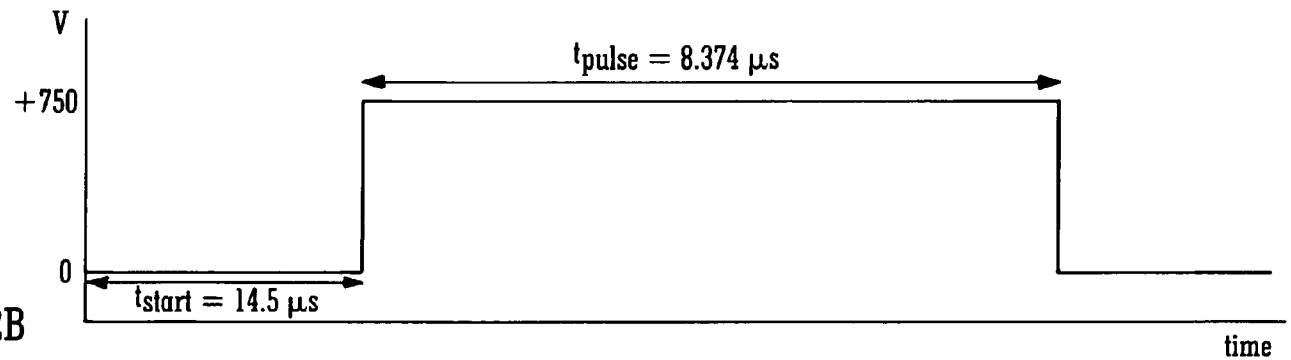

The particular embodiment shown and described in relation to FIGS. 2A and 2B differs from the first embodiment shown and described in relation to FIGS. 1A-1C in that ions having relatively low mass to charge ratios are preferably transmitted straight through the mass filter without ever being orthogonally accelerated into the flight region 3. This is achieved by arranging that ions having a relatively low mass to charge ratio pass through and exit the mass filter before a high voltage pulse is preferably applied to the one or more orthogonal acceleration electrodes 9.

In a similar manner, ions having relatively high mass to charge ratios are also preferably transmitted straight through the mass filter without ever being orthogonally accelerated into the flight region 3. This is achieved by preferably arranging that ions having a relatively high mass to charge ratio arrive at the mass filter only after a high voltage pulse has been applied to the one or more orthogonal acceleration electrodes 9 and the one or more orthogonal acceleration electrodes 9 are no longer being energised.

It will be apparent therefore that according to the second embodiment disclosed and described in relation to FIGS. 2A and 2B, ions having relatively low mass to charge ratios and ions having relatively high mass to charge ratios are preferably transmitted straight through the mass filter without ever being orthogonally accelerated into the flight region 3. Ions having intermediate mass to charge ratios are, however, preferably orthogonally accelerated within the mass filter and are therefore preferably subjected to the preferred method of mass filtering.

In the particular embodiment shown in FIG. 2A the ion source 1 was modelled as being arranged 90 mm further away from the entrance 5*a* of the mass filter than in the first embodiment shown and described in relation to FIG. 1A. In the particular simulation shown and described in relation to FIGS. 2A and 2B, three ions having mass to charge ratios of 400, 1500 and 7000 were modelled as being accelerated to an energy of 500 eV by or within the ion source 1. The mass filter was then operated in a similar mode of operation to the mode of operation described above in relation to the first embodiment shown with reference to FIGS. 1A-1C except that the start or delay time $t_{start}$ was increased. In particular, the start or delay time $t_{start}$ relates to the time from when ions are generated in the ion source 1 to the time when a high voltage pulse is first applied to the one or more orthogonal acceleration electrodes 9. In the second embodiment shown and described in relation to FIG. 2B, the start or delay time $t_{start}$ was preferably increased from 2.5 μs to 14.5 μs. The increase in the start or delay time $t_{start}$ allowed ions having a relatively low mass to charge ratio of 400 to pass straight through the mass filter and reach the exit of the mass filter before a voltage pulse was applied to the one or more orthogonal acceleration electrodes 9. The start or delay time $t_{start}$ was also set such that ions having a desired mass to charge ratio of 1500 were arranged to enter the mass filter and be orthogonally accelerated into the flight region 2 due to the presence of an electric field resulting from the application of a high voltage pulse to the one or more orthogonal acceleration electrodes 9. The start or delay time $t_{start}$ and the length or duration of the voltage pulse $t_{pulse}$ were preferably arranged such that ions having a relatively high mass to charge ratio of 7000 reach the entrance of the mass filter only after the high voltage pulse is no longer being applied to the one or more orthogonal acceleration electrodes 9. Accordingly, ions having a mass to charge ratio of 7000 are transmitted straight through the mass filter without ever being orthogonally accelerated into the flight region 3. The simulation shows that all three ions having mass to charge ratios of 400, 1500 and 7000 were onwardly transmitted by the mass filter.

A voltage timing diagram showing the timing of the high voltage pulse applied to the one or more orthogonal acceleration electrodes 9 in the second embodiment described in relation to FIG. 2A is shown in FIG. 2B. For ease of illustration only, the finite rise and fall time of the high voltage pulse is not shown. However, the rise time and the fall time are both preferably 50 ns.

Figure 3A:
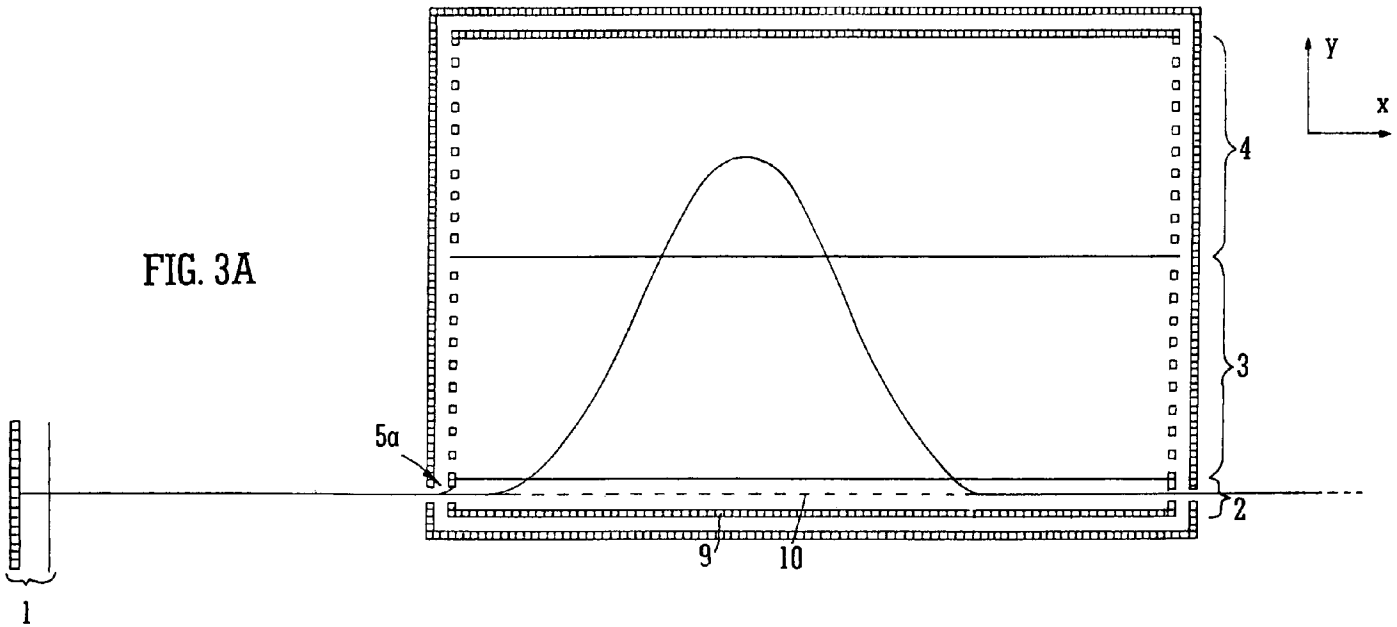
FIG. 3A shows a SIMION (RTM) simulation of a third embodiment wherein ions having relatively low and relatively high mass to charge ratios are arranged to collide with an inlet aperture of the mass filter and FIG. 3B shows a corresponding voltage timing diagram illustrating the delay times and pulse duration of the high voltage pulses applied to an orthogonal acceleration electrode of a mass filter according to the third embodiment.

A variation of the second embodiment described above in relation to FIGS. 2A and 2B will now be described with reference to FIGS. 3A and 3B. According to this third embodiment, the one or more orthogonal acceleration electrodes 9 are preferably initially maintained at a voltage of +750 V (as opposed to 0 V). The one or more orthogonal acceleration electrodes 9 preferably remain at this relatively high potential for a certain period of time $t(1)_{ON}$ which is preferably 11.5 μs. As a result, ions which arrive at the entrance of the mass filter whilst the high voltage pulse is being applied to the one or more orthogonal acceleration electrodes 9 during the time period $t(1)_{ON}$ will preferably be deflected or otherwise orthogonally accelerated immediately upon entering the mass filter. The entrance aperture 5*a* of the mass filter is preferably arranged such that ions which are immediately deflected or otherwise orthogonally accelerated upon entering the mass filter are preferably prevented from passing into the flight region 3 but are instead preferably arranged to collide with a portion of the entrance aperture 5*a* of the mass filter and hence become lost to the system. Other less preferred embodiments are, however, contemplated wherein the ions may initially enter the flight region 3 but wherein the ions are arranged such that they collide with a plate or electrode positioned in the flight region 3 (or another region of the mass filter) and hence become lost to the system.

After the initial time period $t(1)_{ON}$ during which a high voltage pulse is preferably applied to the one or more orthogonal acceleration electrodes 9, the voltage applied to the one or more orthogonal acceleration electrodes 9 is then preferably reduced to 0 V (or a relatively low potential) for a period of time $t(1)_{OFF}$ which is preferably 3 μs. The potential of the one or more orthogonal acceleration electrodes 9 is therefore preferably reduced to zero (or a relatively low potential) immediately prior to the arrival of ions having intermediate mass to charge ratios (which preferably include ions having mass to charge ratios of interest) at the entrance aperture 5*a* of the mass filter.

By appropriate setting of the time periods $t(1)_{ON}$ and $t(1)_{OFF}$, ions having mass to charge ratios less than a certain mass to charge ratio are preferably immediately deflected at the entrance aperture 5*a* of the mass filter and hence are lost to the system whereas ions having mass to charge ratios within an intermediate range are preferably allowed to enter further into the mass filter such that they are then preferably orthogonally accelerated and subjected to the preferred method of mass filtering. After the time period $t(1)_{OFF}$ the one or more orthogonal acceleration electrodes 9 are preferably then subsequently pulsed or maintained at a relatively high potential in a similar manner to the first and second embodiments described above in relation to FIGS. 1A-1C and FIGS. 2A-2B. The one or more orthogonal acceleration electrodes 9 are therefore preferably maintained at a relatively high voltage of e.g. 750 V for a time period $t_{pulse}$ which is preferably 8.374 μs. Accordingly, ions having mass to charge ratios within an intermediate range are preferably orthogonally accelerated in the orthogonal or y-direction into the flight region 3 with the result that certain desired ions will be selected by the preferred mass filtering process of orthogonally accelerating and then fully orthogonally decelerating desired ions. The desired ions will therefore preferably emerge from the exit of the mass filter whilst ions having other mass to charge ratios are preferably arranged to be lost to the system. After ions having desired mass to charge ratios have preferably been returned to the axial or x-direction, the voltage applied to the one or more orthogonal acceleration electrodes 9 is then preferably maintained at 0 V (or a relatively low potential or voltage) for a period of time $t(2)_{OFF}$ which is preferably 3 μs to enable the desired ions to exit the mass filter. After the time period $t(2)_{OFF}$, the potential of the one or more orthogonal acceleration electrodes 9 is then preferably raised to a relatively high voltage of e.g. +750 V once again. The relatively high voltage applied to the one or more orthogonally acceleration electrodes 9 then preferably remains ON for a further time period $t(2)_{ON}$ which may, for example, be 10 μs or longer. The result of reapplying a high voltage to the one or more orthogonal acceleration electrodes 9 is that ions having relatively high mass to charge ratios which are only just approaching or arriving at the entrance of the mass filter (after being generated approximately 26 μs previously) will then preferably be deflected or orthogonally accelerated immediately upon entering the entrance 5*a* of the mass filter. According to the third embodiment, therefore, ions having relatively low mass to charge ratios and also ions having relatively high mass to charge ratios are preferably arranged such that they do not pass into the flight region 3 but rather are preferably arranged such that they collide with a portion of the entrance aperture 5*a* of the mass filter or another part of the mass filter and hence become lost to the system. Other less preferred embodiments are contemplated wherein ions having very low and/or very high mass to charge ratios may be allowed to enter the flight region 3 but then collide with a plate or electrode positioned in the flight region 3 or in another region of the mass filter. Embodiments are also contemplated wherein ions having very low and/or very high mass to charge ratios are deflected to a different portion or region of the mass filter.

Figure 3B:
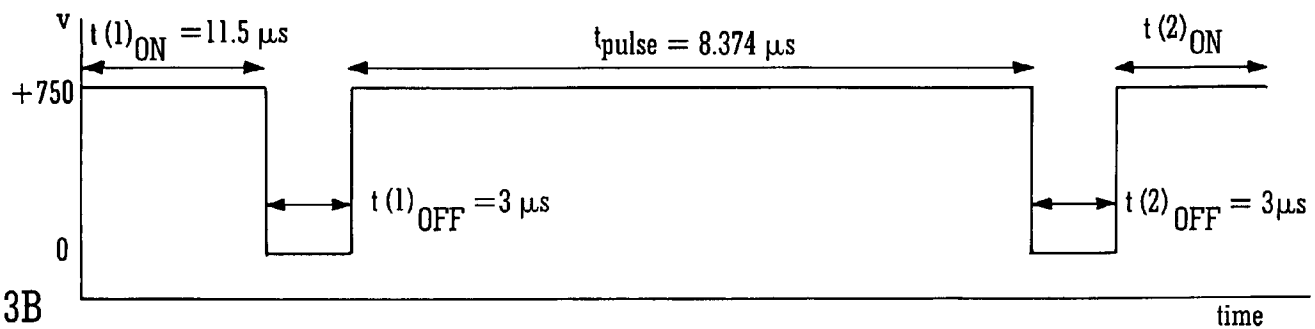

FIG. 3B shows a timing diagram for the voltages applied to the one or more orthogonal acceleration electrodes 9 for the third embodiment modelled and described above in relation to FIG. 3A. For simplicity the finite rise and fall times of the high voltage pulses are not shown but according to a preferred embodiment the voltage pulses have rise and/or fall times of 50 ns.

It can be seen from FIG. 3B that the voltage applied to the one or more orthogonal acceleration electrodes 9 preferably remain initially ON or high for a time period $t(1)_{ON}$ of 11.5 μs. The voltage applied to the one or more orthogonal acceleration electrodes is then preferably switched OFF or remains low for a delay time period $t(1)_{OFF}$ of preferably 3 μs. The one or more orthogonal acceleration electrodes 9 are then preferably energised for a time period $t_{pulse}$ of 8.374 μs in a similar manner to the second embodiment described above in relation to FIG. 2B. The voltage applied to the one or more orthogonal acceleration electrodes 9 is then preferably switched OFF or remains low for a further delay time period $t(2)_{OFF}$ which is preferably 3 μs. The voltage applied to the one or more orthogonal acceleration electrodes 9 is then preferably switched ON or remains high for a further period of time $t(2)_{ON}$ which is preferably at least 10 μs.

The width of the two short delay time periods $t(1)_{OFF}$ and $t(2)_{OFF}$ when the potential of the one or more orthogonal acceleration electrodes 9 is preferably zero (or otherwise relatively low) preferably effectively determines a time window during which ions are able to enter and leave the mass filter. Although FIG. 3B shows that the amplitude of the voltage pulse applied to the one or more orthogonal acceleration electrodes 9 is preferably the same during time periods $t(1)_{ON}$, $t_{pulse}$ and $t(2)_{ON}$, according to other embodiments the amplitude of the voltage pulse may vary or differ such that the amplitude during the time period $t(1)_{ON}$ and/or during the time period $t_{pulse}$ and/or during the time period $t(2)_{ON}$ are all different. Similarly, it will be appreciated that the one or more orthogonal acceleration electrodes 9 may be maintained at potentials other than 750 V and 0 V during the time periods $t(1)_{ON}$, $t)1)_{OFF}$, $t_{pulse}$, $t(2)_{OFF}$ and $t(2)_{ON}$.

Figure 4:
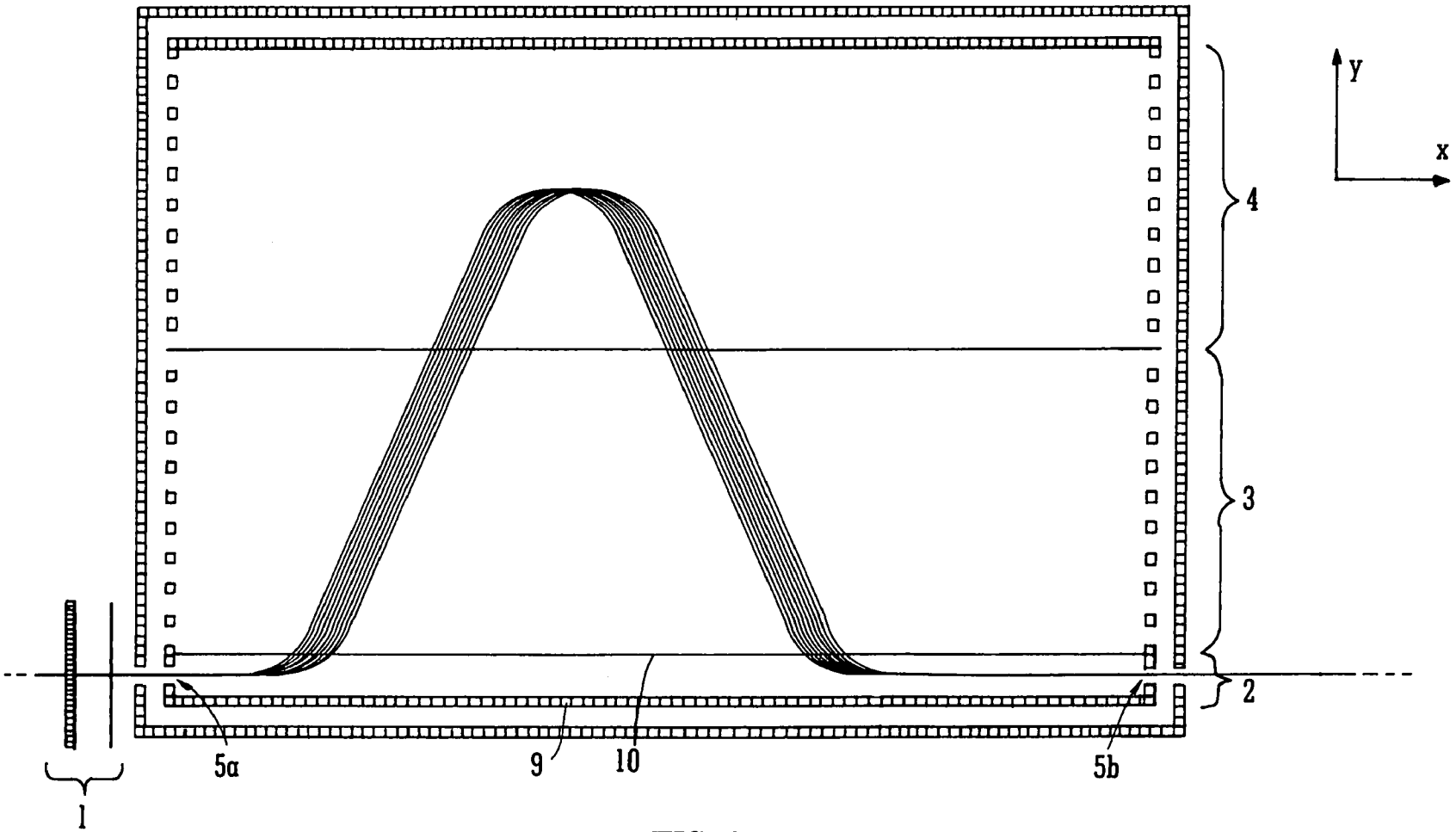
FIG. 4 illustrates the different trajectories through a preferred mass filter of ions having the same mass to charge ratio but a range of initial axial energies.

Known time of flight mass filters and known mass filters incorporating an ion gate suffer from the problem that their overall resolution is reduced due to the ions having an initial finite spread of axial energies or velocities. An important advantage of a mass filter according to the preferred embodiment is that the preferred mass filter is relatively if not substantially wholly immune to any effects due to the ions having an initial spread of axial velocities. FIG. 4 shows a SIMION (RTM) simulation of the trajectories of ten ions having the same mass to charge ratio but having a relatively wide range of initial axial velocities. The ions were orthogonally accelerated in the orthogonal or y-direction within the mass filter according to the preferred embodiment. In the example shown in FIG. 4, the ten ions had a spread of axial energies ranging from 0 eV to 45 eV. The ten ions were then orthogonally accelerated by a voltage pulse applied to the one or more orthogonal acceleration electrodes 9. Such a large spread in axial ion energies is much larger than would be experienced in practice, but the results shown in FIG. 4 serve to illustrate that the mass filter according to the preferred embodiment is nonetheless able to effectively select ions having a desired mass to charge ratio even when the ions to be selected have a wide range of initial axial energies or velocities. As can be seen from FIG. 4, despite the fact that the ions have a wide range of axial energies, all of the ions were orthogonally accelerated and then subsequently orthogonally decelerated such that they returned to their original (axial) path and subsequently emerged from the mass filter. Simulating ions having the same mass to charge ratio and the same initial axial energy but with different creation times led to similar results.

Figure 5:
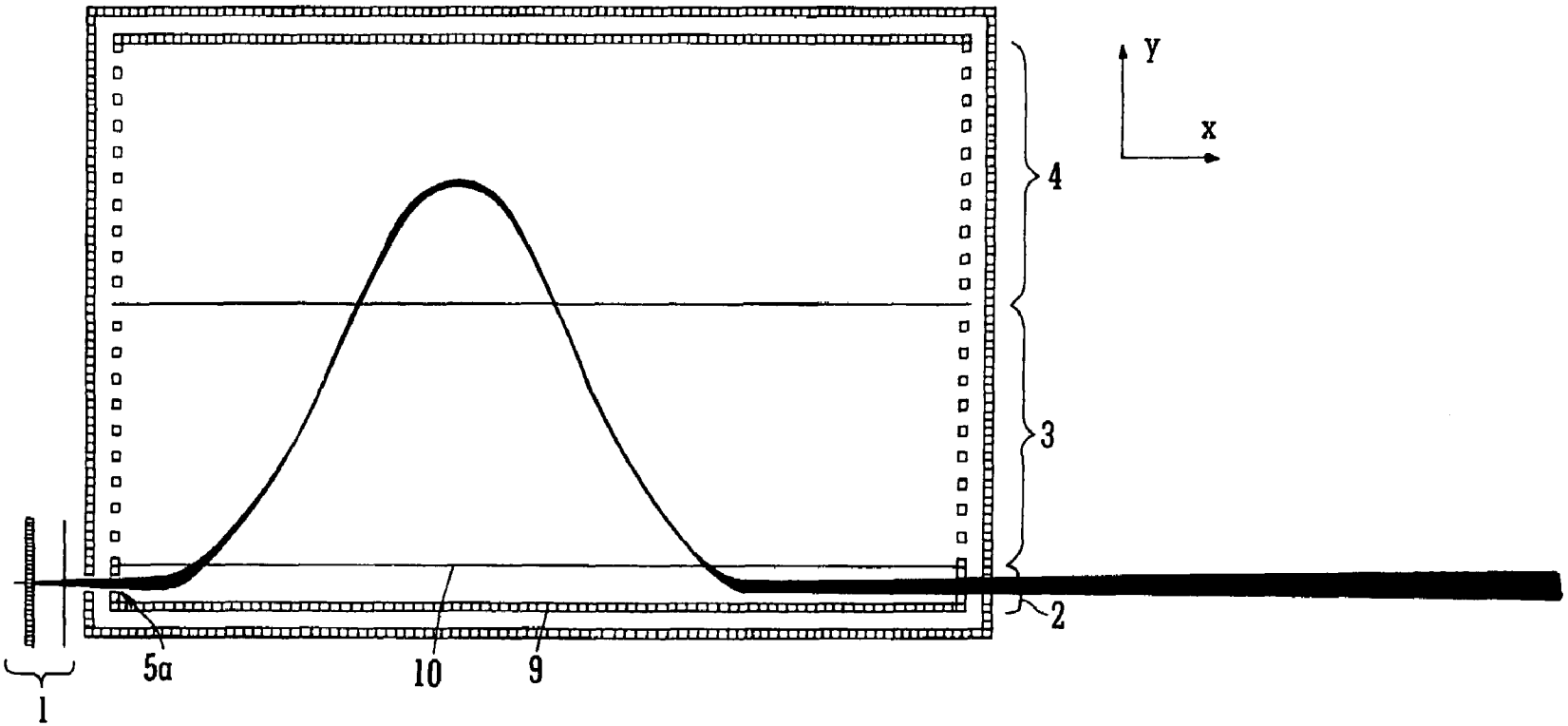
FIG. 5 shows a SIMION (RTM) simulation of the different trajectories of six groups of ions through a preferred mass filter when the ions arriving at the mass filter had a distribution of initial kinetic energies and positions.
Figures 6A, 6B:
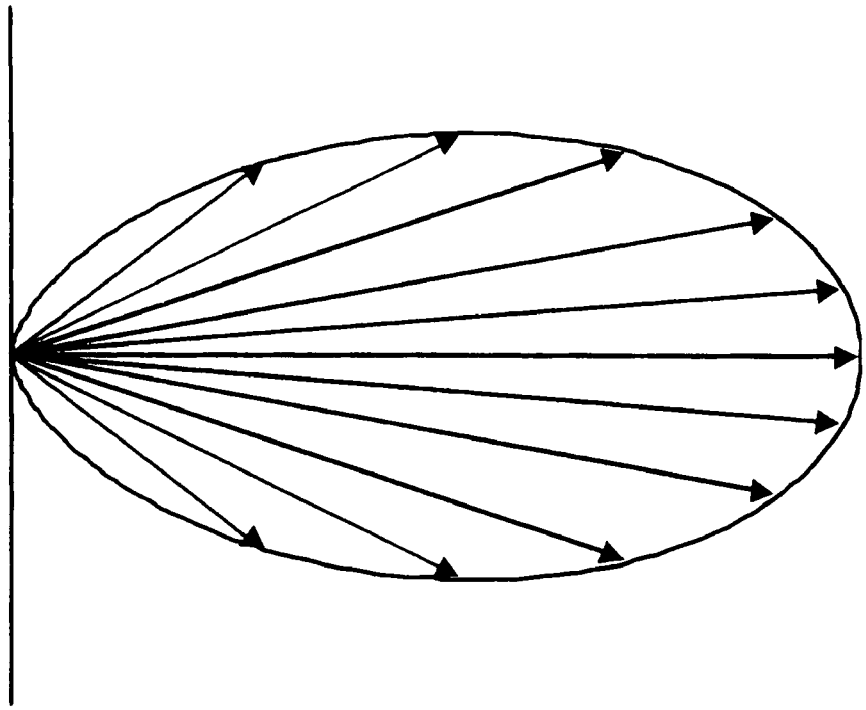
FIG. 6A shows in tabular form the initial kinetic energies and positions for six groups of ions simulated in FIG. 5.
FIG. 6B illustrates the distribution of initial trajectories which ions in a particular group were modelled as having.

FIG. 5 shows the result of a simulation of the performance of a mass filter according to a preferred embodiment when the ions filtered by the mass filter had an initial distribution of energies and positions such as might be encountered experimentally. A total of 540 ions all having a mass to charge ratio of 1500 but having different initial energies and positions were simulated. The ions which were simulated were arranged in six different groups of ions, each group comprising 90 ions. The six groups of ions represent two different starting energies and three different starting positions. The initial starting conditions of the different groups of ions are summarised in FIG. 6A i.e. the ions either had initial relative positions of −0.1 mm, 0 mm or +0.1 mm and either had initial kinetic energies of 0.2 eV or 0.5 eV. All 90 ions within a group were modelled as being initially distributed so as to have an approximate $\cos^2\theta$ distribution of initial ion trajectories. The initial ion trajectories were oriented about the normal to the ion source 1. Such a distribution of initial ion trajectories is shown in FIG. 6B. It is apparent from FIG. 5 that all of the 540 ions were onwardly transmitted through the exit aperture 5*b* of the mass filter.

For the particular conditions modelled in FIG. 5 the size of the virtual object from which the ions appear to originate after exiting the mass filter is increased. By tracing back the final trajectories of the ions, the size of the virtual object was determined to be approximately 1.3 mm for the particular conditions simulated. This represents approximately a ×6 increase in the size of the object prior to mass selection and results in the brightness of the ion beam being reduced.

The brightness of an ion beam is defined as the current density per unit solid angle in the axial direction. As a result, brightness is inversely proportional to the product of the cross sectional area of the beam and the square of the beam divergence. Accordingly, an increase in the width of the ion beam will lead to a decrease in its brightness.

Figure 7:
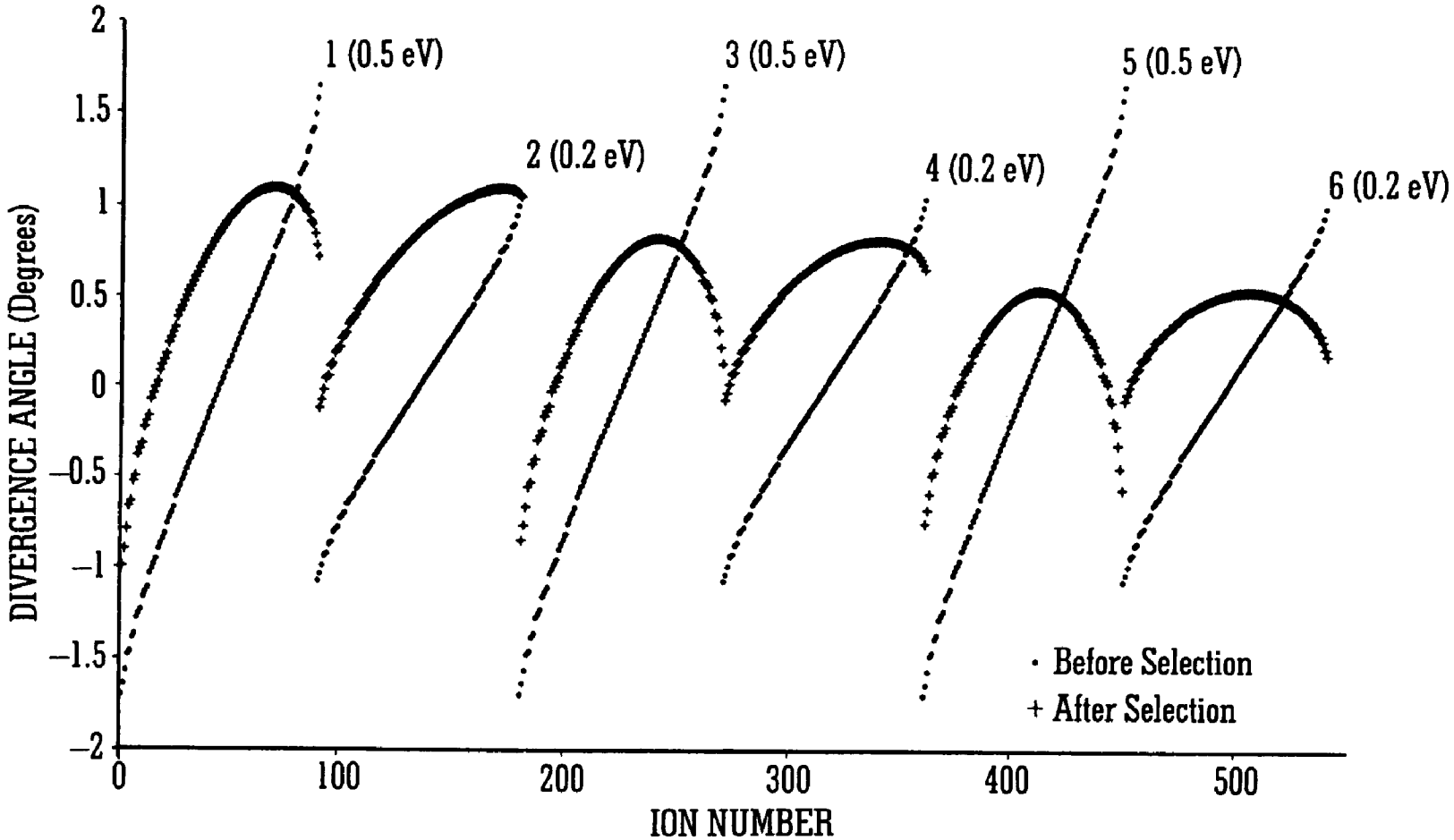
FIG. 7 shows the angular divergence of all the ions modelled in the simulation shown in FIG. 5 both before and after being orthogonally accelerated by the preferred mass filter.

FIG. 7 shows a plot of the angular divergence of all 540 ions in the simulation described above in relation to FIG. 5 and FIGS. 6A-6B. The angular divergence of the ions is shown both prior to being mass filtered by the preferred mass filter and also subsequent to being mass filtered by the preferred mass filter. Prior to mass selection, the ions had a spread of angular divergences which range from approximately +1.7° to −1.7° for ions having a kinetic energy of 0.5 eV and a spread of angular divergences which range from approximately +1.1° to −1.1° for ions having a kinetic energy of 0.2 eV.

After mass selection it can be seen that the angular divergence of the ion beam has now been significantly reduced. The angular divergence now ranges from +1.1 to −1.0 for ions having a kinetic energy of 0.5 eV and from +1.1 to −0.1 for ions having a kinetic energy of 0.2 eV. Accordingly, the mass filter according to the preferred embodiment has the effect of reducing the angular divergence of ions having a kinetic energy of 0.5 eV by 38% and of reducing the angular divergence of ions having a kinetic energy of 0.2 eV ions by 45%.

For ions generated from a point ion source 1 as shown in the simulation shown in FIG. 5, it is possible to achieve optimal focussing and reduce the angular divergence of the ions by a factor of ×2 or more. For ions created at different spatial positions, further embodiments are contemplated wherein a dynamic voltage pulse may be applied to the one or more orthogonal acceleration electrodes 9 in order to improve the overall focussing of the ions. For example, a linear ramp, a sinusoidal or an exponential voltage waveform may be superimposed on the DC level of a square wave or other voltage pulse applied to the one or more orthogonal acceleration electrodes 9.

An additional advantage of the preferred mass filter therefore is that the mass filter may be used to select ions having a certain mass to charge ratio from an ion beam whilst at the same time reducing the angular divergence (and hence velocity spread) of the selected ions. This enables the effect of turn around time to be reduced if the ions are then subsequently passed to an orthogonal acceleration Time of Flight mass analyser for mass analysis. As a result, the preferred mass filter can lead to a significant improvement in the mass resolution of a Time of Flight mass analyser when such a mass analyser is used in conjunction with a mass filter according to the preferred embodiment.

Embodiments are contemplated wherein a high voltage pulse may be applied to the one or more orthogonal acceleration electrodes 9 as a series of two or more short pulses rather than a single long pulse.

Further embodiments are contemplated wherein instead of using a single voltage pulse which remains ON to orthogonally accelerate or orthogonally decelerate ions, two separate voltage pulses may be used, one which starts low and pulses high to accelerate the ions, and one which starts high and pulses low to decelerate the ions.

According to an embodiment the primary acceleration region 2 may be split into two or more regions in order to reduce the capacitance of the electrodes.

In an embodiment a relatively short voltage pulse may be applied to the one or more orthogonally acceleration electrodes 9 in order to initially accelerate the ions giving them all constant momentum. A relatively long voltage pulse may then be applied to orthogonally decelerate the ions once they return to the primary acceleration region 2. According to another embodiment, the ions may be initially accelerated using a relatively long voltage pulse but then orthogonally decelerated using a relatively short voltage pulse which only starts once substantially all of the desired ions having a desired mass to charge ratio have re-entered the primary acceleration region 2.

According to a less preferred embodiment one or more grids or grid electrodes may be provided in the flight region 3 so that the ions travel through a field free region before and/or after reaching the ion mirror or reflectron 4.

According to another less preferred embodiment, instead of reflecting the ions, the ions may alternatively be decelerated in a second accelerating region offset in the y direction which would result in an offset between the filtered and unfiltered beam.

Embodiments are also contemplated wherein a mass filter according to the preferred embodiment may be coupled to another device such as an ion trap. The mass filter may be used primarily to reduce the divergence of an ion beam and indeed the mass filter may be operated in a non-mass filtering mode of operation wherein the device acts solely as an ion guide and transmits substantially all ions received at the entrance to the mass filter.

Although the present invention has been described with reference to preferred embodiments, it will be understood by those skilled in the art that various changes in form and detail may be made without departing from the scope of the invention as set forth in the accompanying claims.

The invention claimed is:

1. A mass filter comprising:

one or more electrodes associated with an entrance region of said mass filter, wherein, in use, one or more first voltage pulses are applied to said one or more electrodes in order to orthogonally accelerate at least some ions away from said one or more electrodes of said entrance region; and one or more ion mirrors for reflecting at least some ions which have been orthogonally accelerated away from said entrance region such that said reflected ions move generally towards an exit region of said mass filter disposed at a distance from said entrance region;

wherein, in use, first ions having a desired mass or mass to charge ratio or having masses or mass to charge ratios within a first desired range are orthogonally decelerated or otherwise orthogonally retarded by one or more electric fields as said first ions approach said exit region of said mass filter.

2. A mass filter as claimed in claim 1, wherein ions are arranged to enter said mass filter substantially in an axial direction, said axial direction being substantially orthogonal to an orthogonal direction.

3. A mass filter as claimed in claim 1, wherein said one or more electrodes comprise one or more pusher and/or puller electrodes for orthogonally accelerating said at least some ions in an orthogonal direction.

4. A mass filter as claimed in claim 1, wherein said one or more first voltage pulses have an amplitude selected from the group consisting of: (i) <50 V; (ii) 50-100 V; (iii) 100-150 V; (iv) 150-200 V; (v) 200-250 V; (vi) 250-300 V; (vii) 300-350 V; (viii) 350-400 V; (ix) 400-450 V; (x) 450-500 V; (xi) 500-550 V; (xii) 550-600 V; (xiii) 600-650 V; (xiv) 650-700 V; (xv) 700-750 V; (xvi) 750-800 V; (xvii) 800-850 V; (xviii) 850-900 V; (xix) 900-950 V; (xx) 950-1000 V; (xxi) 1000-1050 V; (xxii) 1050-1100 V; (xxiii) 1100-1150 V; (xxiv) 1150-1200 V; (xxv) 1200-1250 V; (xxvi) 1250-1300 V; (xxvii) 1300-1350 V; (xxviii) 1350-1400 V; (xxix) 1400-1450 V; (xxx) 1450-1500 V; (xxxi) 1500-1550 V; (xxxii) 1550-1600 V; (xxxiii) 1600-1650 V; (xxxiv) 1650-1700 V; (xxxv) 1700-1750 V; (xxxvi) 1750-1800 V; (xxxvii) 1800-1850 V; (xxxviii) 1850-1900 V; (xxxix) 1900-1950 V; (xxxx) 1950-2000 V; and (xxxxi) >2000 V.

5. A mass filter as claimed in claim 1, wherein said one or more first voltage pulses have a duration $t_{pulse}$.

6. A mass filter as claimed in claim 5, wherein $t_{pulse}$ is selected from the group consisting of: (i) <1 μs; (ii) 1-2 μs; (iii) 2-3 s; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

7. A mass filter as claimed in claim 1, wherein said one or more first voltage pulses are applied after a delay period having a duration $t_{start}$.

8. A mass filter as claimed in claim 7, wherein $t_{start}$ is selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

9. A mass filter as claimed in claim 7, wherein said delay period $t_{start}$ is measured from when ions are first generated in an ion source or in an ion generating region.

10. A mass filter as claimed in claim 1, wherein said one or more first voltage pulses comprise a square wave.

11. A mass filter as claimed in claim 1, wherein said one or more first voltage pulses comprise a linear, ramped, stepped, non-linear, sinusoidal or curved waveform.

12. A mass filter as claimed in claim 1, wherein, in use, ions entering said mass filter have a non-zero component of velocity in an axial direction.

13. A mass filter as claimed in claim 1, wherein, in use, ions entering said mass filter have a substantially zero component of velocity in an orthogonal direction.

14. A mass filter as claimed in claim 1, wherein, in use, at least some of said first ions are orthogonally decelerated or otherwise orthogonally retarded by said one or more electric fields so as to have a substantially zero component of velocity in an orthogonal direction.

15. A mass filter as claimed in claim 1, wherein, in use, at least some of said first ions are orthogonally decelerated or otherwise orthogonally retarded by said one or more electric fields but maintain a substantially non-zero component of velocity in an axial direction.

16. A mass filter as claimed in claim 1, wherein, in use, at least some ions other than said first ions are only partially orthogonally decelerated or otherwise only partially orthogonally retarded by one or more electric fields so that said ions continue with a substantially non-zero component of velocity in an orthogonal direction.

17. A mass filter as claimed in claim 1, wherein, in use, at least some ions other than said first ions are only partially orthogonally decelerated or otherwise only partially orthogonally retarded by one or more electric fields but maintain a substantially non-zero component of velocity in an axial direction.

18. A mass filter as claimed in claim 1, wherein, in use, at least some ions other than said first ions are not substantially orthogonally decelerated or otherwise orthogonally retarded so that said ions continue with a substantially non-zero component of velocity in an orthogonal direction.

19. A mass filter as claimed in claim 1, wherein, in use, at least some ions other than said first ions are not substantially orthogonally decelerated or otherwise orthogonally retarded so that said ions continue whilst maintaining a substantially non-zero component of velocity in an axial direction.

20. A mass filter as claimed in claim 1, wherein said first ions have a mass to charge ratio or have mass to charge ratios falling within one or more ranges x, wherein x is selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

21. A mass filter as claimed in claim 1, wherein, in use, said first ions exit said mass filter.

22. A mass filter as claimed in claim 1, wherein, in use, ions other than said first ions are substantially attenuated or lost within the mass filter.

23. A mass filter as claimed in claim 1, wherein, in use, at least some of said first ions exit said mass filter with a non-zero component of velocity in an axial direction.

24. A mass filter as claimed in claim 1, wherein, in use, at least some of said first ions exit said mass filter with a substantially zero component of velocity in an orthogonal direction.

25. A mass filter as claimed in claim 1, wherein said mass filter comprises one or more flight regions arranged between said one or more electrodes and said one or more ion mirrors.

26. A mass filter as claimed in claim 25, wherein, in use, one or more potential gradients are maintained across at least a portion of said flight region as ions move from said one or more electrodes towards said one or more ion mirrors, wherein said one or more potential gradients act so as to further accelerate at least some ions towards said one or more ion mirrors.

27. A mass filter as claimed in claim 25, wherein, in use, one or more potential gradients are maintained across at least a portion of said flight region as ions move from said one or more ion mirrors towards said one or more electrodes, wherein said one or more potential gradients act so as to decelerate at least some ions as they approach said one or more electrodes.

28. A mass filter as claimed in claim 25, wherein, in use, at least a portion of said flight region comprises one or more field free regions, wherein ions in said one or more field free regions are neither accelerated nor decelerated as they move in said one or more field free regions towards said one or more ion mirrors.

29. A mass filter as claimed in claim 25, wherein, in use, at least a portion of said flight region comprises one or more field free regions, wherein ions in said one or more field free regions are neither accelerated nor decelerated as they move in said one or more field free regions from said one or more ion mirrors towards said one or more electrodes.

30. A mass filter as claimed in claim 1, wherein said one or more ion mirrors comprises one or more reflectrons.

31. A mass filter as claimed in claim 30, wherein a linear or non-linear electric field gradient is maintained within one or more of said reflectrons or ion mirrors.

32. A mass filter as claimed in claim 1, wherein, in use, at least some second ions having undesired masses or mass to charge ratios having been reflected by said one or more ion mirrors approach said exit region of said mass filter and are reflected by one or more electric fields.

33. A mass filter as claimed in claim 32, wherein at least some of said second ions are reflected by said one or more electric fields into a flight region.

34. A mass filter as claimed in claim 32, wherein at least some of said second ions are reflected by said one or more electric fields away from said exit region of said mass filter.

35. A mass filter as claimed in claim 32, wherein said second ions include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-

1850; (xxxviii) 1850-1900; (xxxix) 1900-1950; (xxxx) 1950-2000; and (xxxxi) >2000.

36. A mass filter as claimed in claim 1, wherein, in use, at least some third ions having undesired masses or mass to charge ratios having been reflected by said one or more ion mirrors approach said exit region of said mass filter and are only partially orthogonally decelerated or otherwise only partially orthogonally retarded.

37. A mass filter as claimed in claim 36, wherein at least some of said third ions continue through the exit region of said mass filter.

38. A mass filter as claimed in claim 37, wherein, in use, at least some of said third ions do not exit from said mass filter.

39. A mass filter as claimed in claim 37, wherein, in use, at least some of said third ions impinge upon said one or more electrodes.

40. A mass filter as claimed in claim 37, wherein, in use, at least some of said third ions are substantially attenuated or lost within the mass filter.

41. A mass filter as claimed in claim 36, wherein said third ions include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

42. A mass filter as claimed in claim 1, wherein, in use, at least some fourth ions having masses or mass to charge ratios within a fourth range pass through said mass filter without being orthogonally accelerated whilst at least some other ions having different masses or mass to charge ratios are orthogonally accelerated.

43. A mass filter as claimed in claim 42, wherein said fourth ions include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

44. A mass filter as claimed in claim 42, wherein, in use, at least some of said fourth ions are onwardly transmitted to the exit of said mass filter.

45. A mass filter as claimed in claim 1, wherein, in use, at least some fifth ions having masses or mass to charge ratios within a fifth range pass through said mass filter without being orthogonally accelerated whilst at least some other ions having different masses or mass to charge ratios are orthogonally accelerated.

46. A mass filter as claimed in claim 45, wherein said fifth ions have a mass to charge ratio selected from the group consisting of: (i)<50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

47. A mass filter as claimed in claim 45, wherein, in use, at least some of said fifth ions are onwardly transmitted to the exit of said mass filter.

48. A mass filter as claimed in claim 1, wherein, in use, at least some sixth ions having masses or mass to charge ratios within a sixth range are orthogonally accelerated substantially immediately upon entering said mass filter.

49. A mass filter as claimed in claim 48, wherein, in use, at least some of said sixth ions are arranged to collide with a plate or electrode forming part of the entrance region of said mass filter.

50. A mass filter as claimed in claim 48, wherein, in use, at least some of said sixth ions are substantially attenuated or lost within the mass filter.

51. A mass filter as claimed in claim 48, wherein said sixth ions include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400 450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

52. A mass filter as claimed in claim 1, wherein one or more second voltage pulses are applied, in use, to said one or more electrodes prior to said one or more first voltage pulses.

53. A mass filter as claimed in claim 52, wherein said one or more second voltage pulses have a duration $t(1)_{ON}$.

54. A mass filter as claimed in claim 53, wherein $t(1)_{ON}$ is selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

55. A mass filter as claimed in claim 52, wherein the voltage applied to said one or more electrodes is reduced for a period of time $t(1)_{OFF}$ after said one or more second voltage pulses are applied to said one or more electrodes and prior to said one or more first voltage pulses.

56. A mass filter as claimed in claim 55, wherein $t(1)_{OFF}$ is selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii)

11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

57. A mass filter as claimed in claim 1, wherein, in use, at least some seventh ions having masses or mass to charge ratios within a seventh range are orthogonally accelerated substantially immediately upon entering said mass filter.

58. A mass filter as claimed in claim 57, wherein, in use, at least some of said seventh ions are arranged to collide with a plate or electrode forming part of the entrance region of said mass filter.

59. A mass filter as claimed in claim 57, wherein, in use, at least some of said seventh ions are substantially attenuated or lost within the mass filter.

60. A mass filter as claimed in claim 57, wherein said seventh ions include ions having a mass to charge ratio selected from the group consisting of: (i) <50; (ii) 50-100; (iii) 100-150; (iv) 150-200; (v) 200-250; (vi) 250-300; (vii) 300-350; (viii) 350-400; (ix) 400-450; (x) 450-500; (xi) 500-550; (xii) 550-600; (xiii) 600-650; (xiv) 650-700; (xv) 700-750; (xvi) 750-800; (xvii) 800-850; (xviii) 850-900; (xix) 900-950; (xx) 950-1000; (xxi) 1000-1050; (xxii) 1050-1100; (xxiii) 1100-1150; (xxiv) 1150-1200; (xxv) 1200-1250; (xxvi) 1250-1300; (xxvii) 1300-1350; (xxviii) 1350-1400; (xxix) 1400-1450; (xxx) 1450-1500; (xxxi) 1500-1550; (xxxii) 1550-1600; (xxxiii) 1600-1650; (xxxiv) 1650-1700; (xxxv) 1700-1750; (xxxvi) 1750-1800; (xxxvii) 1800-1850; (xxxviii) 1850-1900; (xxxix) 1900-1950; (xxxx) 1950-2000; and (xxxxi) >2000.

61. A mass filter as claimed in claim 1, wherein one or more third voltage pulses are applied, in use, to said one or more electrodes subsequent to said one or more first voltage pulses.

62. A mass filter as claimed in claim 61, wherein said one or more third voltage pulses have a duration $t(2)_{ON}$.

63. A mass filter as claimed in claim 62, wherein $t(2)_{ON}$ is selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (Xxix) 28-29 μs; (xxx) 29-30 μs; and (xxxi) >30 μs.

64. A mass filter as claimed in claim 61, wherein the voltage applied to said one or more electrodes is reduced for a period of time $t(2)_{OFF}$ after said one or more first voltage pulses are applied to said one or more electrodes and prior to said one or more third voltage pulses being applied to said one or more electrodes.

65. A mass filter as claimed in claim 64, wherein $t(2)_{OFF}$ is selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xxii) 11-12 μs; (xxiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-21 μs; (xxii) 21-22 μs; (xxiii) 22-23 μs; (xxiv) 23-24 μs; (xxv) 24-25 μs; (xvi) 25-26 μs; (xvii) 26-27 μs; (xviii) 27-28 μs; (xxix) 28-29 μs; (xxx) 29-30 μs; and (xxxi) >30 μs.

66. A mass filter as claimed in claim 1, wherein said first ions have a first range of angular divergence $\Delta\theta_1$ immediately prior to or upon entering said mass filter.

67. A mass filter as claimed in claim 1, wherein said first ions have a second range of angular divergence $\Delta\theta_2$ immediately prior to or upon exiting said mass filter.

68. A mass filter as claimed in claim 66, wherein the ratio of said first range of angular divergence to said second range of angular divergence $\Delta\theta_1/\Delta\theta_2$ is selected from the group consisting of (i) >1; (ii) 1-1.1; (iii) 1.1-1.2; (iv) 1.2-1.3; (v) 1.3-1.4; (vi) 1.4-1.5; (vii) 1.5-1.6; (viii) 1.6-1.7; (ix) 1.7-1.8; (x) 1.8-1.9; (xi) 1.9-2.0; and (xii) >2.

69. A mass spectrometer comprising a mass filter as claimed in claim 1.

70. A mass spectrometer as claimed in claim 69, further comprising an ion source arranged upstream of said mass filter.

71. A mass spectrometer as claimed in claim 70, wherein said ion source is selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Laser Desorption Ionisation ("LDI") ion source; (v) an Inductively Coupled Plasma ("ICP") ion source; (vi) an Electron Impact ("EI") ion source; (vii) a Chemical Ionisation ("CI") ion source; (viii) a Field Ionisation ("FI") ion source; (ix) a Fast Atom Bombardment ("FAB") ion source; (x) a Liquid Secondary Ion Mass Spectrometry ("LSIMS") ion source; (xi) an Atmospheric Pressure Ionisation ("API") ion source; (xii) a Field Desorption ("FD") ion source; (xiii) a Matrix Assisted Laser Desorption Ionisation ("MALDI") ion source; (xiv) a Desorption/Ionisation on Silicon ("DIOS") ion source; and (xv) a Desorption Electrospray Ionisation ("DESI") ion source.

72. A mass spectrometer as claimed in claim 70, wherein said ion source comprises a continuous ion source.

73. A mass spectrometer as claimed in claim 70, wherein said ion source comprises a pulsed ion source.

74. A mass spectrometer as claimed in claim 69, further comprising a mass analyser arranged downstream of said mass filter.

75. A mass spectrometer as claimed in claim 74, wherein said mass analyser is selected from the group consisting of: (i) an orthogonal acceleration Time of Flight mass analyser; (ii) an axial acceleration Time of Flight mass analyser; (iii) a quadrupole mass analyser; (iv) a Penning mass analyser; (v) a Fourier Transform Ion Cyclotron Resonance ("FTICR") mass analyser; (vi) a 2D or linear quadrupole ion trap; (vii) a Paul or 3D quadrupole ion trap; and (viii) a magnetic sector mass analyser.

76. A method of mass filtering ions comprising:

providing one or more electrodes associated with an entrance region of a mass filter;

applying one or more first voltage pulses to said one or more electrodes in order to orthogonally accelerate at least some ions away from said one or more electrodes of said entrance region;

reflecting at least some ions which have been orthogonally accelerated away from said entrance region such that said ions move generally towards an exit region of said mass filter disposed at a distance from said entrance region; and orthogonally decelerating or otherwise orthogonally retarding by means of one or more electric fields first ions having a desired mass or mass to charge ratio or having masses or mass to charge ratios within a first desired range as said first ions approach said exit region of said mass filter.

* * * * *